US009937705B2

(12) United States Patent
Young

(10) Patent No.: US 9,937,705 B2
(45) Date of Patent: Apr. 10, 2018

(54) LIQUID EJECTION HOLE CONFIGURATION FOR WEB GUIDE

(71) Applicant: Eastman Kodak Company, Rochester, NY (US)

(72) Inventor: Timothy John Young, Williamson, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 15/158,716

(22) Filed: May 19, 2016

(65) Prior Publication Data

US 2017/0157917 A1 Jun. 8, 2017

Related U.S. Application Data

(60) Provisional application No. 62/261,998, filed on Dec. 2, 2015.

(51) Int. Cl.

| | |
|---|---|
| ***B65H 20/14*** | (2006.01) |
| ***C23C 18/16*** | (2006.01) |
| ***B65H 23/24*** | (2006.01) |
| ***B05C 3/02*** | (2006.01) |
| ***B05C 3/12*** | (2006.01) |
| ***B41F 21/00*** | (2006.01) |
| ***B41F 5/24*** | (2006.01) |

(52) U.S. Cl.

CPC ..... *B41F 21/00* (2013.01); *B05C 3/125* (2013.01); *B41F 5/24* (2013.01); *B65H 20/14* (2013.01); *C23C 18/16* (2013.01); *C23C 18/163* (2013.01); *C23C 18/1619* (2013.01); *B65H 2406/111* (2013.01); *B65H 2406/112* (2013.01)

(58) Field of Classification Search

CPC ..... B65H 23/24; B65H 2406/02

See application file for complete search history.

(56) References Cited

U.S. PATENT DOCUMENTS

| | | | | |
|---|---|---|---|---|
| 3,065,098 A | | 11/1962 | Brooks | |
| 3,097,971 A | * | 7/1963 | Carlisle | B21C 47/34 134/122 R |
| 3,186,326 A | * | 6/1965 | Schmidt | G03D 3/13 226/196.1 |
| 3,197,339 A | * | 7/1965 | Black | B65G 49/0404 134/122 R |
| 4,138,047 A | * | 2/1979 | Sherman | B65H 23/24 134/15 |

(Continued)

FOREIGN PATENT DOCUMENTS

| | | |
|---|---|---|
| WO | 2009/044124 | 4/2009 |
| WO | 2013/063188 | 3/2013 |

*Primary Examiner* — Binu Thomas
(74) *Attorney, Agent, or Firm* — Kevin E. Spaulding

(57) ABSTRACT

A non-contact web guide includes a wall having a curved exterior surface and a hollow interior containing a pressurized liquid. A first row of liquid ejection holes is provided in proximity to the web guide entry position, second and third rows of liquid ejection holes is provided in proximity to the web guide exit position, and an intermediate array of liquid ejection holes is provided between the first and second rows. A total number of liquid ejection holes in the intermediate array is less than a total number of liquid ejection holes in the second row. This configuration of ejection boles provides the advantage that stable web guidance is achieved at low liquid flow rates.

23 Claims, 18 Drawing Sheets

(56) References Cited

U.S. PATENT DOCUMENTS

| | | | | | |
|---|---|---|---|---|---|
| 5,015,509 | A * | 5/1991 | Rey | B05C 3/125 | 118/405 |
| 5,102,118 | A * | 4/1992 | Vits | B65H 23/24 | 226/196.1 |
| 5,353,979 | A * | 10/1994 | Gartmann | B65H 23/035 | 226/15 |
| 5,525,751 | A * | 6/1996 | Niederkorn | D06B 23/04 | 118/419 |
| 2009/0110809 | A1 * | 4/2009 | Buschbeck | B65H 23/24 | 427/74 |
| 2013/0192757 | A1 | 8/2013 | Lymn | | |

* cited by examiner

LIQUID EJECTION HOLE CONFIGURATION FOR WEB GUIDE

CROSS-REFERENCE TO RELATED APPLICATIONS

This application claims the benefit of U.S. Provisional Patent Application No. 62/261,998, filed Dec. 2, 2015, which is incorporated herein by reference in its entirety.

Reference is made to commonly-assigned, U.S. patent application Ser. No. 15/158,678 (now U.S. Publication No. 2017/0157916), entitled LIQUID EJECTION HOLE ORIENTATION FOR WEB GUIDE, filed herewith, by T. Young, which is incorporated herein by reference.

FIELD OF THE INVENTION

This invention pertains to the field of web transport systems that include at least one web guide having a liquid bearing for non-contact guidance of the web, and more particularly to an arrangement of liquid ejection holes.

BACKGROUND OF THE INVENTION

Processing a web of media in a roll-to-roll fashion can be an advantageous and low-cost manufacturing approach for devices or other objects formed on the web of media. A number of manufacturing methods, such as etching, plating, developing, or rinsing include processing the media in a tank of liquid chemicals. Transporting the web of media through the liquid chemicals can provide technical challenges, especially if rollers are used to guide the web of media, as is conventionally done. An example of a process that includes web transport through liquid chemicals is roll-to-roll electroless plating.

Electroless plating, also known as chemical or autocatalytic plating, is a plating process that involves chemical reactions in an aqueous plating solution that occur without the use of external electrical power. Typically, the plating occurs as hydrogen is released by a reducing agent and oxidized, thus producing a negative charge on the surface of the part to be plated. The negative charge attracts metal ions out of the plating solution to adhere as a metalized layer onto the surface. Using electroless plating to provide metallization in predetermined locations can be facilitated by first depositing a catalytic material in the predetermined locations. This can be done, for example, by printing features using an ink containing a catalytic component. Conventionally, electroless plating has typically been performed by immersing the item to be plated in a tank of plating solution. However, for high volume plating of features on both sides of a web of substrate material, it is preferable to perform the electroless plating in a roll-to-roll electroless plating system.

Touch screens are visual displays with areas that can be configured to detect both the presence and location of a touch by, for example, a finger, a hand or a stylus. Touch screens can be found in many common devices such as televisions, computers, computer peripherals, mobile computing devices, automobiles, appliances and game consoles, as well as in other industrial, commercial and household applications. A capacitive touch screen includes a substantially transparent substrate which is provided with electrically conductive patterns that do not excessively impair the transparency—either because the conductors are made of a material, such as indium tin oxide, that is substantially transparent, or because the conductors are sufficiently narrow that the transparency is provided by the comparatively large open areas not containing conductors. For capacitive touch screens having metallic conductors, it is advantageous for the features to be highly conductive but also very narrow. Capacitive touch screen sensor films are an example of an article having very fine features with improved electrical conductivity resulting from an electrolessly-plated metal layer.

Projected capacitive touch technology is a variant of capacitive touch technology. Projected capacitive touch screens are made up of a matrix of rows and columns of conductive material that form a grid. Voltage applied to this grid creates a uniform electrostatic field, which can be measured. When a conductive object, such as a finger, comes into contact, it distorts the local electrostatic field at that point. This is measurable as a change in capacitance. The capacitance can be measured at every intersection point on the grid. In this way, the system is able to accurately track touches. Projected capacitive touch screens can use either mutual capacitive sensors or self capacitive sensors. In mutual capacitive sensors, there is a capacitor at every intersection of each row and each column. A 16×14 array, for example, would have 224 independent capacitors. A voltage is applied to the rows or columns. Bringing a finger or conductive stylus close to the surface of the sensor changes the local electrostatic field which reduces the mutual capacitance. The capacitance change at every individual point on the grid can be measured to accurately determine the touch location by measuring the voltage in the other axis. Mutual capacitance permits multi-touch operation where multiple fingers, palms or styli can be accurately tracked at the same time.

WO 2013/063188 (Petcavich et al.) discloses a method of manufacturing a capacitive touch sensor using a roll-to-roll process to print a conductor pattern on a flexible transparent dielectric substrate. A first conductor pattern is printed on a first side of the dielectric substrate using a first flexographic printing plate, and is then cured. A second conductor pattern is printed on a second side of the dielectric substrate using a second flexographic printing plate, and is then cured. The ink used to print the patterns includes a catalyst that acts as seed layer during a subsequent electroless plating operation. The electrolessly-plated material (e.g., copper) provides the low resistivity in the narrow lines of the grid needed for excellent performance of the capacitive touch sensor. Petcavich et al. indicate that the line width of the flexographically-printed material can be 1 to 50 microns.

Flexography is a method of printing or pattern formation that is commonly used for high-volume printing runs. It is typically employed in a roll-to-roll format for printing on a variety of soft or easily deformed materials including, but not limited to, paper, paperboard stock, corrugated board, polymeric films, fabrics, metal foils, glass, glass-coated materials, flexible glass materials and laminates of multiple materials. Coarse surfaces and stretchable polymeric films are also economically printed using flexography.

Flexographic printing members are sometimes known as relief printing members, relief-containing printing plates, printing sleeves, or printing cylinders, and are provided with raised relief images onto which ink is applied for application to a printable material. While the raised relief images are inked, the recessed relief "floor" should remain free of ink.

Although flexographic printing has conventionally been used in the past for printing of images, more recent uses of flexographic printing have included functional printing of devices, such as touch screen sensor films, antennas, and other devices to be used in electronics or other industries. Such devices typically include electrically conductive patterns.

To improve the optical quality and reliability of the touch screen, it has been found to be preferable that the width of the grid lines be approximately 2 to 10 microns, and even more preferably to be 4 to 8 microns. In addition, in order to be compatible with the high-volume roll-to-roll manufacturing process, it is preferable for the roll of flexographically printed material to be electroless plated in a roll-to-roll electroless plating system.

Patterns, especially fine line patterns that are plated using electroless plating systems, are often delicate and susceptible to being damaged as the web of substrate is transported along the web-transport path. For example, particulates can be located on the media support surface of a roller that contacts the web surface and cause scratches as the web of media passes. Therefore it is desirable to minimize contact between the web of media and hard surfaces where abrasion can occur.

WO 2009/044124 (Lymn), entitled "Web processing machine," discloses a web transport system using submerged fluid bearings in which process liquid is directed through apertures to lift the web of media away from the bearing surface. In Lymn's preferred embodiment, it is contemplated that non-submerged upper web guides that are located above the liquid level can also use fluid bearings where air is used as the fluid. However, Lymn also contemplates using process liquid in place of air in a non-submerged upper web. U.S. Patent Application Publication No. 2013/0192757 (Lymn), also entitled "Web processing machine," describes a configuration including drying guides over a processing tank. The guides have outlet slits through which air is blown to provide a bearing medium as well as a drying medium.

U.S. Pat. No. 3,065,098 (Brooks), entitled "Method for coating webs" provides air ejected through tubes to float a web along an undulating path. The holes are formed radially in the tube walls.

U.S. Pat. No. 3,186,326 (Schmidt), entitled "Fluid bearings for strip material" teaches ejecting processing liquid through holes in a tube for providing a fluid bearing for a web of media.

An objective for web guides that support the web of media using liquid bearings is to provide sufficient standoff (i.e., the distance between the web of media and the surface of the web guide) in order to reduce the likelihood of the web of media contacting the web guide surface. It is preferable to provide sufficient web standoff with a relatively low flow rate of ejected liquid in the liquid bearings. Furthermore, it is desirable to provide stable web transport without web flutter that can increase the chances of the web contacting the web guide surface. Finally, it is advantageous to control the ejection of liquid such that the ejected liquid is not wasted or cause contamination.

There remains a need for improved web transport systems using liquid bearings that can reduce the occurrence of scratches due to web contact with the web guide, while using a reduced amount of ejected liquid and providing improved flow control of the ejected liquid.

SUMMARY OF THE INVENTION

The present invention represents a web transport system for transporting a web of media along a web transport path in an in-track direction, the web of media having a width in a cross-track direction, includes:

at least one web guide for non-contact guidance of the web of media including:

a wall having a curved exterior surface, wherein the web of media travels along the web transport path around a bearing portion of the curved exterior surface from a web guide entry position to a web guide exit position, thereby redirecting the web of media from an input travel direction to an output travel direction;

a hollow interior containing a pressurized liquid;

a first row of liquid ejection holes formed through the wall from the hollow interior to the curved exterior surface, the liquid ejection holes in the first row being distributed along a line spanning the web guide in the cross-track direction in proximity to the web guide entry position;

a second row of liquid ejection holes formed through the wall from the hollow interior to the curved exterior surface, the liquid ejection holes in the second row being distributed along a line spanning the web guide in a cross-track direction in proximity to the web guide exit position; and an intermediate array of liquid ejection holes formed through the wall from the hollow interior to the curved exterior surface disposed along the web transport path between the first row of liquid ejection holes and the second row of liquid ejection holes, the liquid ejection holes in the intermediate array being distributed across the web guide in the cross-track direction, wherein a total number of liquid ejection holes in the intermediate array is less than a total number of liquid ejection holes in the second row;

wherein the pressurized liquid flows through the liquid ejection holes to force the web of media away from the bearing surface of the web guide so that the web of media does not contact the web guide as it travels around the bearing portion of the curved exterior surface.

This invention has the advantage that it provides non-contact web guidance at a relatively low flow rate of ejected liquid through the holes of the web guide.

It has the additional advantage that it provides stable web transport without appreciable web flutter is provided.

It has the further advantage that it provides improved control of the ejection of liquid is provided such that the ejected liquid is not wasted and does not cause contamination.

Figure 1:
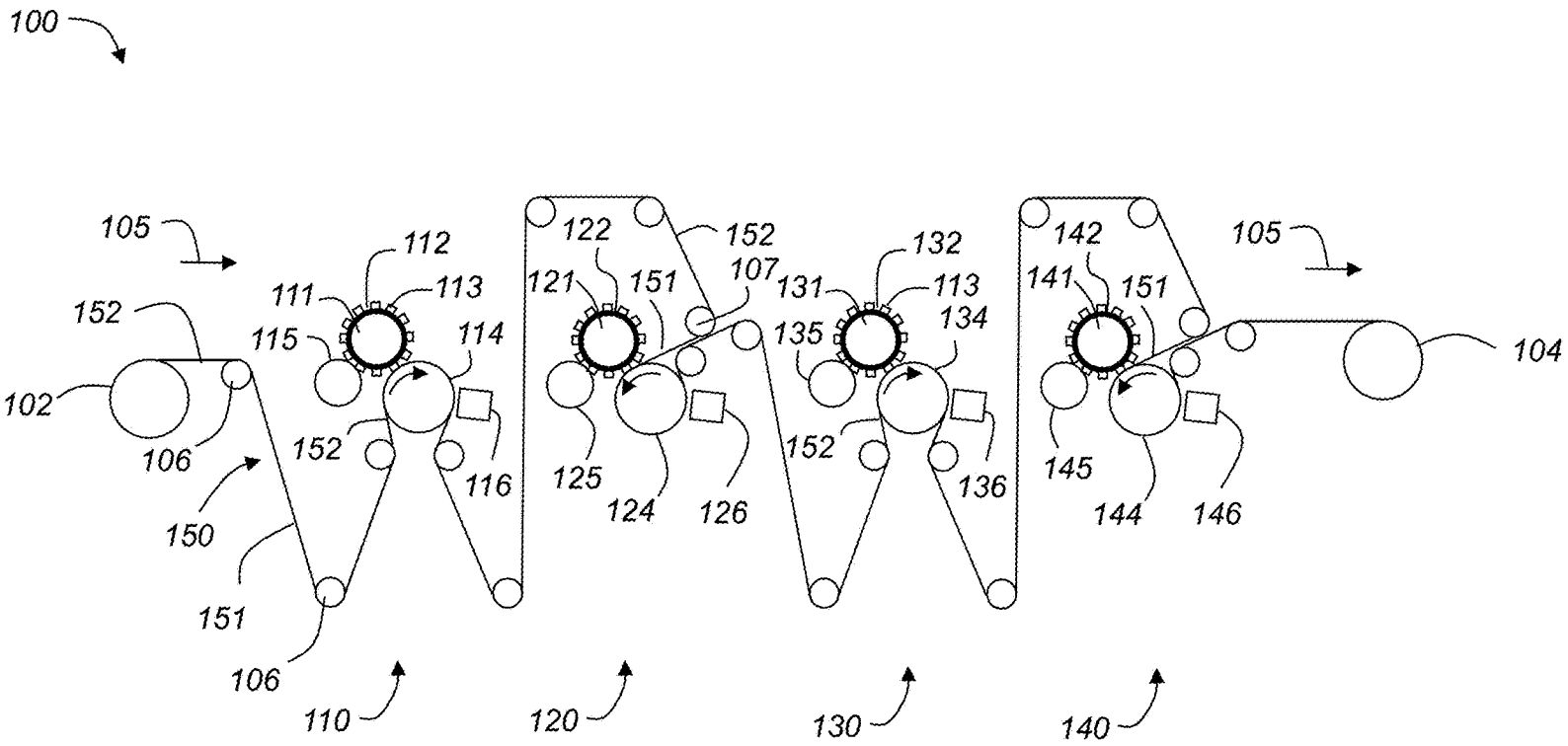
FIG. 1 is a schematic side view of a flexographic printing system for roll-to-roll printing on both sides of a web of media.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

References to upstream and downstream herein refer to direction of flow. A web of media moves along a media path in a web advance direction from upstream to downstream. Similarly, fluids flow through a fluid line in a direction from upstream to downstream. In some instances a fluid can flow in an opposite direction from the web advance direction. For clarification herein, upstream and downstream are meant to refer to the web motion unless otherwise noted.

As described herein, the example embodiments of the present invention describe a roll-to-roll electroless plating system for providing web transport without contacting the surface of the web with a hard surface such as a roller. The roll-to-roll electroless plating system is useful for metalizing printed features in sensor films incorporated into touch screens. However, many other applications are emerging for printing and electroless plating of functional devices that can be incorporated into other electronic, communications, industrial, household, packaging and product identification systems (such as RFID) in addition to touch screens. In addition, roll-to-roll electroless plating systems can be used to plate items for decorative purposes rather than electronic purposes and such applications are contemplated as well. Furthermore, there are many other applications of liquid processing of a web of media in a roll-to-roll configuration in addition to electroless plating. There can also be applications of roll-to-roll web transport where a liquid bearing can be used for guiding a web of media without contact and where no liquid processing or tanks of processing liquids are used.

FIG. 1 is a schematic side view of a flexographic printing system 100 that can be used for roll-to-roll printing of a catalytic ink on both sides of a substrate 150 for subsequent electroless plating. Substrate 150 is fed as a web of media from supply roll 102 to take-up roll 104 through flexographic printing system 100. Substrate 150 has a first side 151 and a second side 152. Within the context of the present disclosure, the term "web of media" is used interchangeably with the terms "substrate" or "web of substrate."

The flexographic printing system 100 includes two print modules 120 and 140 that are configured to print on the first side 151 of substrate 150, as well as two print modules 110 and 130 that are configured to print on the second side 152 of substrate 150. The web of substrate 150 travels overall in roll-to-roll direction 105 (left to right in the example of FIG. 1). However, various rollers 106 and 107 are used to locally change the direction of the web of substrate 150 as needed for adjusting web tension, providing a buffer, and reversing the substrate 150 for printing on an opposite side. In particular, note that in print module 120 roller 107 serves to reverse the local direction of the web of substrate 150 so that it is moving substantially in a right-to-left direction.

Each of the print modules 110, 120, 130, 140 includes some similar components including a respective plate cylinder 111, 121, 131, 141, on which is mounted a respective flexographic printing plate 112, 122, 132, 142, respectively. Each flexographic printing plate 112, 122, 132, 142 has raised features 113 defining an image pattern to be printed on the substrate 150. Each print module 110, 120, 130, 140 also includes a respective impression cylinder 114, 124, 134, 144 that is configured to force a side of the substrate 150 into contact with the corresponding flexographic printing plate 112, 122, 132, 142. Impression cylinders 124 and 144 of print modules 120 and 140 (for printing on first side 151 of substrate 150) rotate counter-clockwise in the view shown in FIG. 1, while impression cylinders 114 and 134 of print modules 110 and 130 (for printing on second side 152 of substrate 150) rotate clockwise in this view.

Each print module 110, 120, 130, 140 also includes a respective anilox roller 115, 125, 135, 145 for providing ink to the corresponding flexographic printing plate 112, 122, 132, 142. As is well known in the printing industry, an anilox roller is a hard cylinder, usually constructed of a steel or aluminum core, having an outer surface containing millions of very fine dimples, known as cells. Ink is provided to the anilox roller by a tray or chambered reservoir (not shown). In some embodiments, some or all of the print modules 110, 120, 130, 140 also include respective UV curing stations 116, 126, 136, 146 for curing the printed ink on substrate 150.

Figure 2:
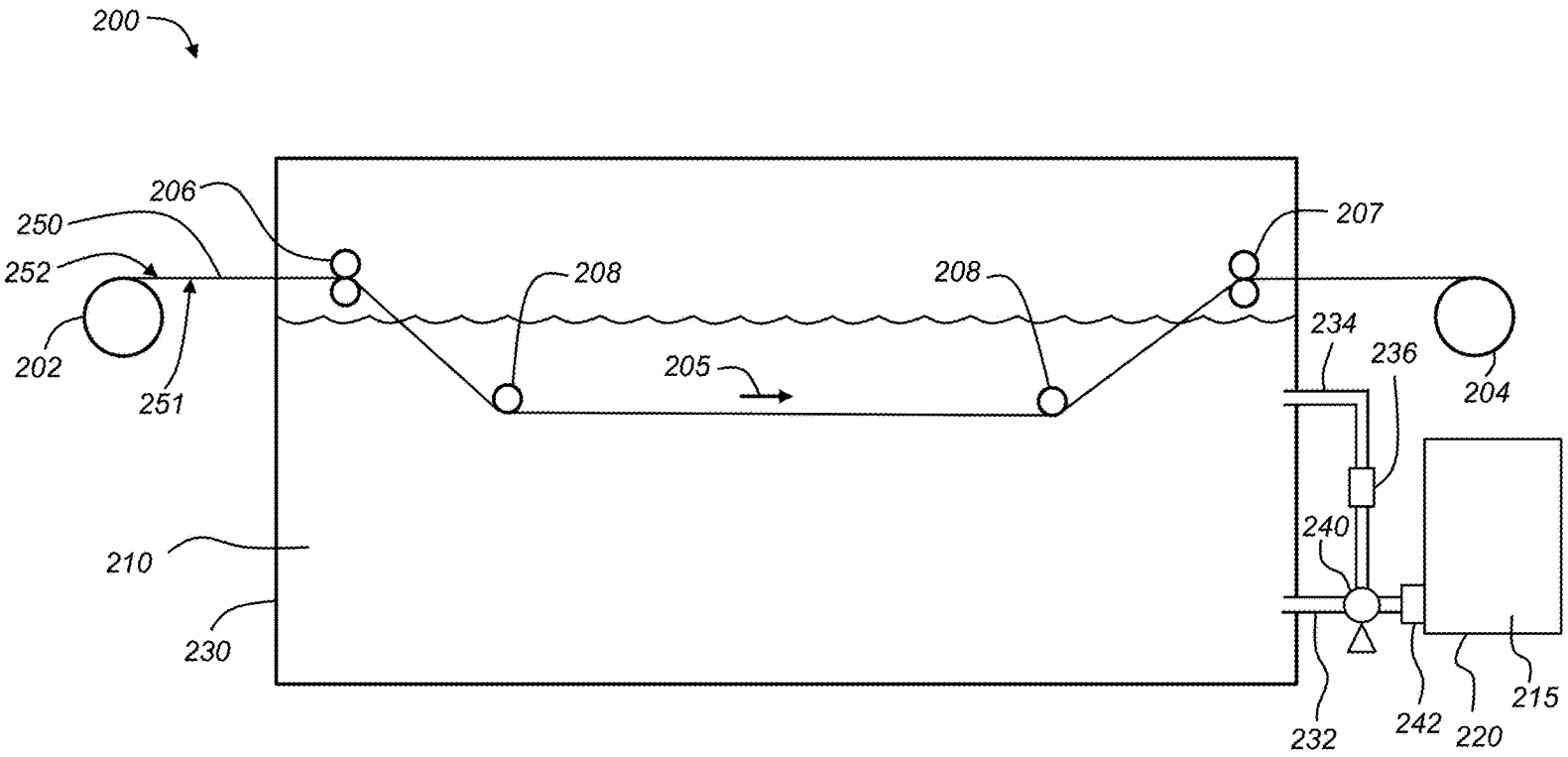
FIG. 2 (Prior Art)
FIG. 2 is a schematic side view of a roll-to-roll electroless plating system.

FIG. 2 is a schematic side view of a roll-to-roll electroless plating system 200 disclosed in commonly-assigned, co-pending U.S. patent application Ser. No. 14/571,328 entitled "Roll-to-roll electroless plating system with liquid flow bearing," by S. Reuter et al., which is incorporated herein by reference. The roll-to-roll electroless plating system 200 includes a tank 230 of plating solution 210. A web of media 250 is fed by a web advance system along a web-transport path in an in-track direction 205 from a supply roll 202 to a take-up roll 204. The web of media 250 is a substrate upon which electroless plating is to be performed. A drive roller 206 is positioned upstream of the plating solution 210 and a drive roller 207 is positioned downstream of the plating solution 210. Drive rollers 206 and 207 advance the web of media 250 from the supply roll 202 through the tank of plating solution 210 to the take-up roll 204. Web-guiding rollers 208 are at least partially submerged in the plating solution 210 in the tank 230 and guide the web of media 250 along the web-transport path in the in-track direction 205.

As the web of media 250 is advanced through the plating solution 210 in the tank 230, a metallic plating substance such as copper, silver, gold, nickel or palladium is electrolessly plated from the plating solution 210 onto predetermined locations on one or both of a first surface 251 and a second surface 252 of the web of media 250. As a result, the concentration of the metal or other components in the plating solution 210 in the tank 230 decreases and the plating solution 210 needs to be refreshed. To refresh the plating solution 210, it is recirculated by a pump 240, and replenished plating solution 215 from a reservoir 220 is added under the control of a controller 242, which can include a valve (not shown). In the example shown in FIG. 2, plating solution 210 is moved from tank 230 to pump 240 through a drain pipe 232 and is returned from pump 240 to tank 230 through a return pipe 234. In order to remove particulates from plating solution 210, a filter 236 can be included, typically downstream of the pump 240.

Particulates can be present in plating solution 210 due to contaminants that enter from outside of the tank 230, or can be generated from hardware within tank 230, or can result from spontaneous plating out of metal from the electroless plating solution 210. Particulates that settle on the bottom of the tank 230 do not represent a significant problem. However, particulates that fall onto the web of media 250 and become trapped between web of media 250 and one of the drive rollers 206, 207 or web-guiding rollers 208 can cause significant problems due to scratching of the delicate patterns formed on the web of media 250. In some cases, a particulate can become embedded in a roller and cause scratches in successive portions of the web of media 250 that contact it.

Figure 3:
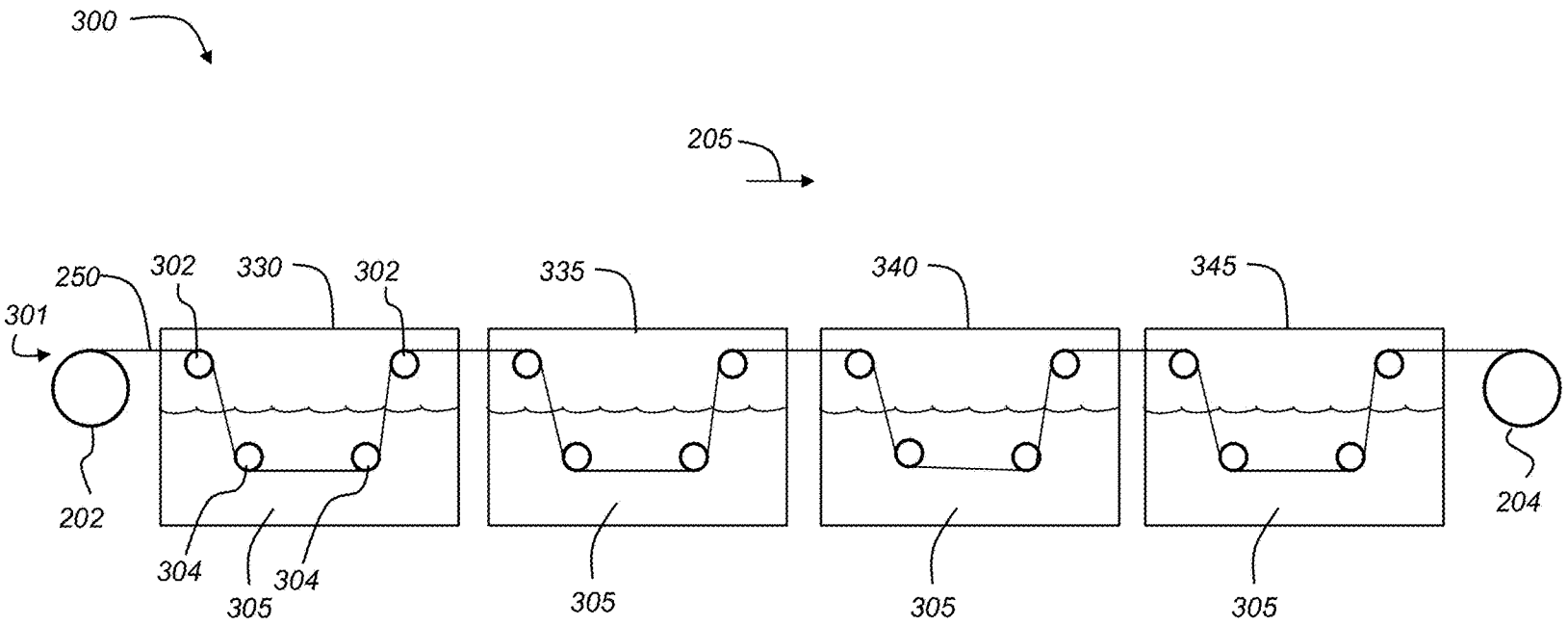
FIG. 3 is a schematic side view of a multi-stage roll-to-roll liquid processing system.

A roll-to-roll liquid processing system 300 for processing a web of media 250 can have a plurality of processing tanks 330, 335, 340, 345, as shown schematically in FIG. 3. The web of media 250 is transported successively through the processing tanks 330, 335, 340, 345 by web transport system 301 as it travels from the supply roll 202 to the take-up roll 204. Each successive processing tank 330, 335, 340, 345 can contain a different processing liquid 305, or some or all of the processing tanks 330, 335, 340, 345 can contain the same processing liquid 305.

In an exemplary configuration, the roll-to-roll liquid processing system 300 is an electroless plating line for plating touch screen sensor films on catalytic ink patterns printed by flexographic printing system 100 of FIG. 1. In this case, the processing tanks 330, 340 can be plating tanks containing electroless plating solution, and the processing tanks 335, 345 can be rinse tanks containing a rinsing liquid. For example, the processing liquid 305 in processing tank 330 can be a copper plating solution; the processing liquid 305 in processing tank 335 can be water for rinsing the web of media 250; the processing liquid 305 in processing tank 340 can be a palladium plating solution; and the processing liquid 305 in processing tank 345 can be water for rinsing the web of media 250.

The web of media 250 is transported along in-track direction 205 into each successive processing tank 330, 335, 340, 345 where it is submerged in the associated processing liquid 305, and then transported out of the processing tank 330, 335, 340, 345 and into the next processing tank 330, 335, 340, 345, and finally to the take-up roll 204. Web transport guides for each tank include both non-submerged web guides 302 and submerged web guides 304.

U.S. patent application Ser. No. 14/812,078 to Hill et al., entitled "Web transport system including scavenger blade" and incorporated by reference herein in its entirety, teaches the use of a scavenger blade to remove at least some liquid that was ejected at the bearing surface of a non-submerged fluid bar or web guide from the surface of the web of media. Such scavenger blades can be useful in conjunction with the non-submerged web guides 302 of FIG. 3.

Embodiments of the invention provide improved performance of web guides that support a web of media using liquid bearings. In particular, the disclosed liquid bearing configurations provide sufficient stand-off (i.e., the distance between the web of media 250 and the surface of the web guide) to reduce the likelihood of the web of media 250 contacting the web guide surface. The disclosed configurations have the advantage that they provide non-contact web guidance at a relatively low flow rate of ejected liquid in the liquid bearings. In addition, stable web transport without appreciable web flutter is provided. Furthermore, improved control of the ejection of liquid is provided such that the ejected liquid is not wasted and does not cause contamination.

Figure 4:
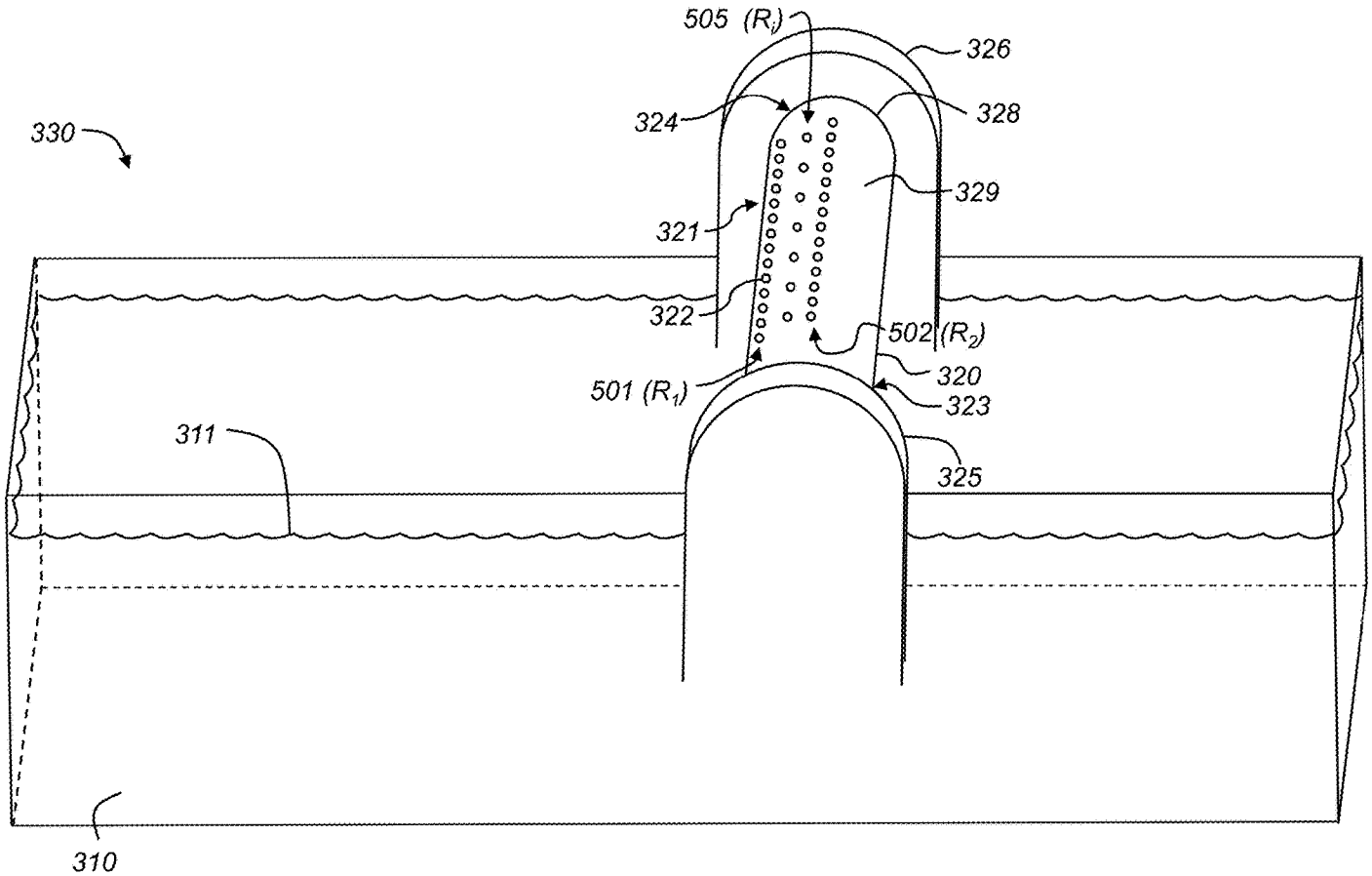
FIG. 4 is a cutaway perspective of a plating tank including a non-submerged non-contact web guide according to an embodiment of the invention.

FIG. 4 is a perspective of a processing tank 330 including a reservoir of processing liquid 310 (e.g., a plating solution) that fills the processing tank 330 up to a liquid level 311. A non-contact web guide 320 has a curved wall 328 with a curved exterior surface 329. The curved exterior surface 329 has an arrangement of liquid ejection holes 322 within or near a bearing surface 321 portion. In the embodiment shown in FIG. 4, the arrangement of liquid ejection holes 322 includes a first array 501, a second array 502, and an optional intermediate array 505 that is disposed between the first array 501 and the second array 502. In the illustrated arrangement, there are fewer liquid ejection holes 322 in the intermediate array 505 than there are in either the first array 501 or the second array 502, although this is not required.

In the example of FIG. 4, the first array 501 is a linear array including liquid ejection holes 322 distributed along a line to form a first row $R_1$ across the web guide 320, and the second array 502 is a linear array including liquid ejection holes 322 distributed along a line to form a second row $R_2$. Likewise, the intermediate array 505 is also a linear array including liquid ejection holes 322 distributed along a line to form an intermediate row $R_i$. In other embodiments, some or all of the arrays of liquid ejection holes 322 can be twodimensional arrays including liquid ejection holes 322 distributed along a plurality of lines, or can include liquid ejection holes 322 arranged in other types of patterns such as hexagonal patterns.

Preferably, bearing surface 321 has a smooth cross-section. In the illustrated configuration, the curved exterior surface 329 of the web guide 320 has a circular cross-section so that the cross-section of the bearing surface 321 is a circular arc.

Web guide 320 is supported at its first end 323 by a first mount 325, and at its second end 324 by a second mount 326. Processing liquid 310 is forced through the liquid ejection holes 322 by a pump (not shown). Web guide 320 can have a hollow interior 327 (see FIG. 6) that is in fluidic communication with the liquid ejection holes 322. Processing liquid 310 can be supplied to the web guide 320 through appropriate plumbing (not shown) between the pump and the hollow interior 327. In some configurations, the plumbing can be adjacent to or within one or both of the first mount 325 and the second mount 326.

In the exemplary configuration of FIG. 4, the liquid ejection holes 322 in the web guide 320 are above the liquid level 311 (although other portions of the web guide 320 may or may not be above liquid level 311). In the terminology used herein, a web guide 320 is said to be "non-submerged" if at least some of the liquid ejection holes 322 through which processing liquid 310 is ejected are above liquid level 311.

Figure 5:
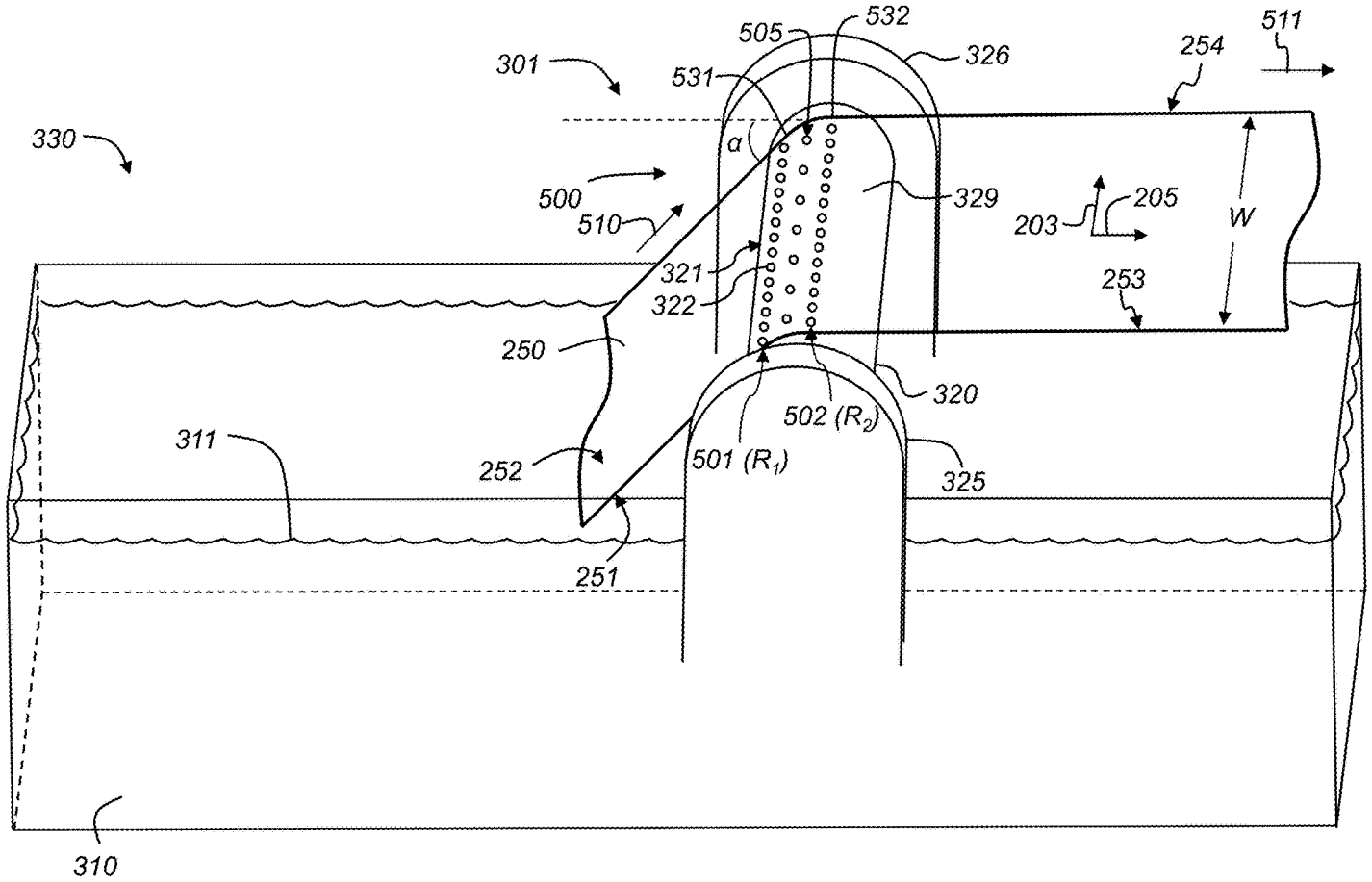
FIG. 5 shows a portion of a web of media being guided around the non-submerged non-contact web guide of FIG. 4.

FIG. 5 shows a shows a portion of a web transport system 301 in which a web of media 250 is guided in non-contact fashion along a web transport path 500 around and past the non-submerged web guide 320 of FIG. 4. The web of media 250 travels in an in-track direction 205 and extends widthwise in a cross-track direction 203 from a first edge 253 to a second edge 254 to define a width W. The web guide 320 spans the width of the web of media 250. The web of media 250 has a first surface 251 and an opposing second surface 252, where the first surface 251 faces the bearing surface 321 of the web guide 320. The bearing surface 321 is defined to be the portion of the exterior surface of the web guide 320 around which the web of media 250 is wrapped. As will be described in more detail below with reference to FIG. 7, the bearing surface 321 extends from a web guide entry position 531 to a web guide exit position 532.

The first array 501 of liquid ejection holes 322 is located in proximity to the web guide entry position 531, and the second array 502 of liquid ejection holes 322 is located in proximity to the web guide exit position 532. The liquid ejection holes 322 in the first array 501, the second array 502, and the intermediate array 505 are distributed across the web guide 320 in the cross-track direction 203. In the example shown in FIG. 5, the liquid ejection holes 322 of first array 501 are distributed as a linear array along a line spanning the web guide 320 in the cross-track direction 203 to form a first row $R_1$. Similarly, the liquid ejection holes 322 of second array 502 are distributed as a linear array along a line spanning the web guide 320 in the cross-track direction 203 to form a second row $R_2$. The optional intermediate array 505 includes additional liquid ejection holes 322 that are not located near either the web guide entry position 531 or the web guide exit position 532. In the exemplary configuration of FIG. 5, the liquid ejection holes 322 of the intermediate array 505 are distributed as a linear array along a line spanning the web guide 320 in the cross-track direction 203. In other embodiments, the liquid ejection holes 322 of the intermediate array 505 can be arranged along a plurality of lines or in some other configuration.

As the web of media 250 approaches the web guide 320 it is traveling in an input travel direction 510, and as the web of media 250 moves away from the web guide 320 it is traveling in an output travel direction 511. The angle between the input travel direction 510 and the output travel direction 511 defines a wrap angle $\alpha$. As pressurized processing liquid 310 is pumped through the liquid ejection holes 322 in the bearing surface 321 into a region between the first surface 251 of the web of media 250 and the bearing surface 321 of the web guide 320, the web of media 250 is forced away from the web guide 320. This permits guiding of the web of media 250 without scratching it by contact with the web guide 320.

As shown schematically in FIG. 3, web guides in a web transport system 301 can have a variety of configurations. They can include non-submerged web guides 302 and submerged web guides 304, and can have a variety of different wrap angles. It has been found that preferred configurations of liquid ejection holes 322 can depend on variables such as these, as well as other variables including web tension, web stiffness, orientation of the bearing surface, and characteristics of the ejected liquid. Several examples for non-submerged and submerged web guides having different wrap angles are described herein.

Figure 6:
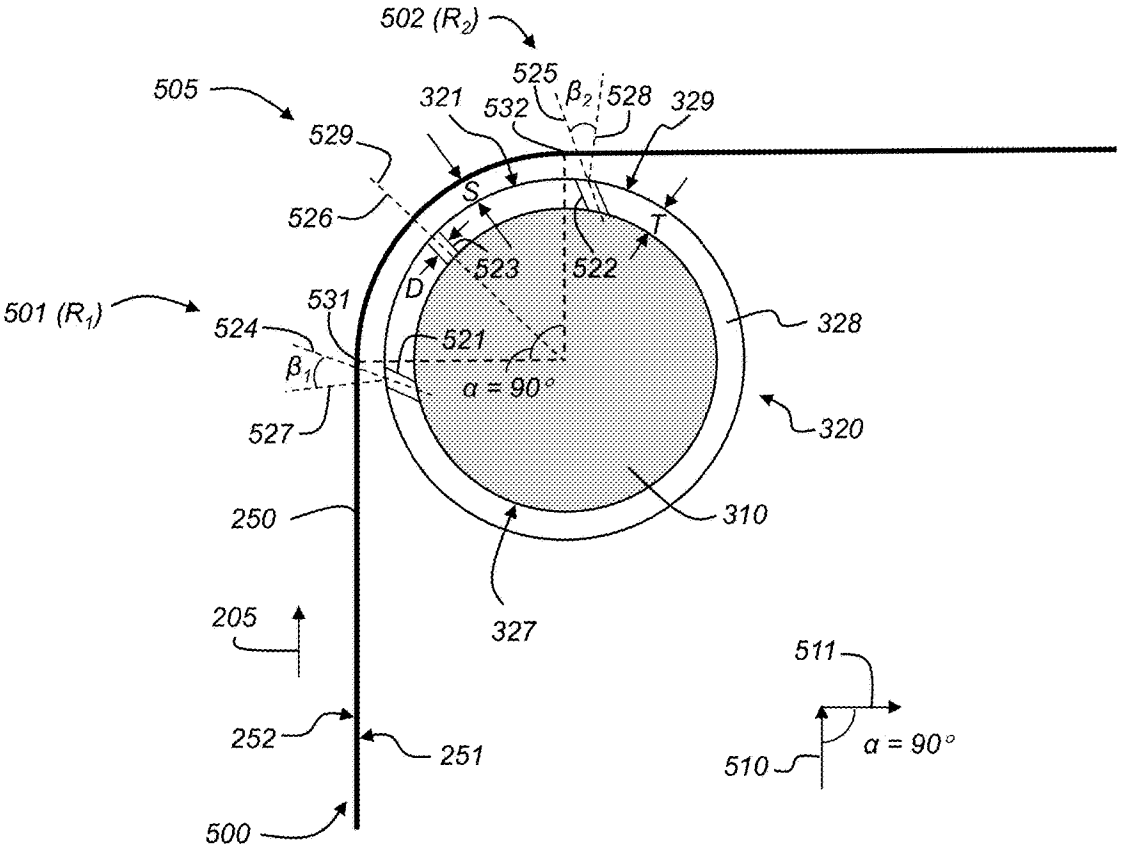
FIG. 6 shows a cross-sectional view of a non-contact web guide configuration having a wrap angle of 90 degrees illustrating the orientations of liquid ejection holes.

FIG. 6 shows a cross-sectional view of an exemplary non-contact web guide 320. In the illustrated configuration, the web guide 320 has a cylindrical shape with a circular cross-section. However, in other embodiments, the web guide 320 can have other shapes. The bearing surface 321 will preferably have a smoothly-varying profile, such as an arc of a circle or an ellipse. Other types of smoothly-varying profiles would include a curve corresponding to some other type of conic section or smoothly-varying function. Aside from the bearing surface 321 over which the web of media 250 rides, the other surfaces of the web guide 320 can have any shape (e.g., they can be flat surfaces).

The web of media 250 does not touch the bearing surface 321, but is forced outward to a stand-off distance S with respect to the bearing surface 321 by the pressurized liquid (e.g., processing liquid 310) that is pumped into the hollow interior 327 of web guide 320 and is ejected through liquid ejection holes 521, 522, 523. The stand-off distance S is the gap between the web of media 250 and the bearing surface 321. The stand-off distance S is preferably large enough to prevent against contact between the web of media 250 and the bearing surface 321.

The web guide 320 of FIG. 6 has a wrap angle $\alpha$ of 90 degrees between the input travel direction 510 and the output travel direction 511. With reference also to FIG. 5, processing liquid 310 that is pressurized within the hollow interior 327 of the web guide 320 is ejected through liquid ejection holes 521 of the first array 501, liquid ejection holes 522 of the second array 502, and liquid ejection holes 523 of the intermediate array 505. Web guide 320 has a curved wall 328 having a wall thickness T with a curved exterior surface 329. Liquid ejection holes 521, 522, 523 are formed through the curved wall 328 from the hollow interior 327 to the curved exterior surface 329. All of the liquid ejection holes in this example have the same characteristic shape and size, but they have different orientations relative to the curved wall 328. Although in general the hole diameter and the hole shape can vary from hole to hole and from array to array, in an exemplary configuration, the liquid ejection holes 521, 522, 523 are circular and have a diameter that is within 10% of a value which is referred to as the characteristic diameter D herein. It has been found to be advantageous if the ratio of the wall thickness T to the characteristic diameter D is between about 1.5 and 3.0. For example, in an embodiment where the wall thickness T was 3.0 mm, it was found that the best liquid bearing performance in terms of stand-off distance, total flow, and web stability was for a characteristic diameter D of about 1.5 mm (a ratio of 2.0). In other embodiments (not shown) the liquid ejection holes can have a non-circular shape, including shapes such as ovals or rectangular slots.

As shown in FIG. 6, axes 524 of the liquid ejection holes 521 in the first array 501 located in proximity to the web guide entry position 531 are not perpendicular to the curved exterior surface 329 of curved wall 328, but rather are inclined toward a downstream direction of the web transport path 500 (i.e., the position of the axes 524 at the curved exterior surface 329 is father downstream than the position of the axes 524 at the hollow interior 327) by a first inclination angle $\beta_1$ relative to a normal 527 to the curved exterior surface 329. Similarly, axes 525 of the liquid ejection holes 522 in the second array 502 located in proximity to the web guide exit position 532 are not perpendicular to the curved exterior surface 329 of curved wall 328. Rather, the axes 525 are inclined toward an upstream direction of the web transport path 500 (i.e., the position of the axes 525 at the curved exterior surface 329 is father upstream than the position of the axes 525 at the hollow interior 327) by a second inclination angle $\beta_2$ relative to a normal 528 to the curved exterior surface 329. In other words the direction that the processing liquid 310 is ejected through both the first array 501 and the second array 502 (FIG. 5) is into the region where the web of media 250 is wrapped around the bearing surface 321 (i.e., the portion of the curved exterior surface 329 between the web guide entry position 531 and the web guide exit position 532). In the illustrated configuration, the liquid ejection holes 523 of the intermediate array 505 are oriented with their axes 526 coincident with the normal 529 to the curved exterior surface 329 (i.e., the axes 526 are perpendicular to the curved exterior surface 329.) For a circular curved exterior surface 329 as in the configuration of FIG. 6, this implies that the axis 526 of the liquid ejection holes 523 of the intermediate array 505 are oriented radially.

By tilting the axes 524, 525 of the first array 501 and the second array 502 inward into the region where the web of media 250 is wrapped around the bearing surface 321, it has been found that less liquid is required to be ejected from the intermediate array 505. Consequently, if the liquid ejection holes 523 have the same diameter as the liquid ejection holes 521, 522, fewer liquid ejection holes 523 are required in the intermediate array 505. More generically, a total cross-sectional area of the liquid ejection holes 523 in the intermediate array 505 can be less than a total cross-sectional area of the liquid ejection holes 521 in the first array 501 (row $R_1$) and also less than a total cross-sectional area of the liquid ejection holes 522 in the second array 502 (row $R_2$), where the total cross-sectional area of an array of liquid ejection holes is the sum of the cross-sectional areas for all of the liquid ejection holes in that array.

The hole configurations described herein, including the inclination of liquid ejection holes 521 of the first array 501 and the liquid ejection holes 522 of the second array 502 for ejecting liquid into the region where the web of media 250 is wrapped around the bearing surface 321, enable the use of a lower flow rate of ejected liquid. Additionally, it has been found that such configurations provide the additional advantage that the web of media 250 moves with improved stability without appreciable vibration. As a result, the stand-off distance S between the web of media 250 and the bearing surface 321 can be maintained at a relatively small distance of between about 0.5 mm and 1.0 mm. It has been found that using the hole configurations described herein such a stand-off distance S can be maintained while using a cumulative flow rate of processing liquid 310 through the liquid ejection holes of less than 25 gallons/minute or even 20 gallons/minute for a 17 inch wide web guide. This flow rate is approximately 30% less than was found to be required for other hole configurations that were previously tested. In addition, by directing the ejected processing liquid 310 into the web wrap region, less ejected processing liquid 310 tends to be directed along the web of media 250 toward upstream or downstream processing tanks. This decreases the likelihood of processing liquid 310 leaving the corresponding processing tank and being wasted or contaminating the processing solution in a neighboring processing tank.

It has been found that that it is advantageous for the first inclination angle $\beta_1$ and the second inclination angle $\beta_2$ to have magnitudes that are between 15 degrees and 45 degrees. In the example shown in FIG. 6 both $\beta_1$ and $\beta_2$ have magnitudes of approximately 30 degrees but are of opposite sign. Furthermore, in some embodiments the magnitude of the first inclination angle $\beta_1$ is substantially equal to the magnitude of the second inclination angle $\beta_2$ (i.e., equal to within about 5 degrees).

Figure 7:
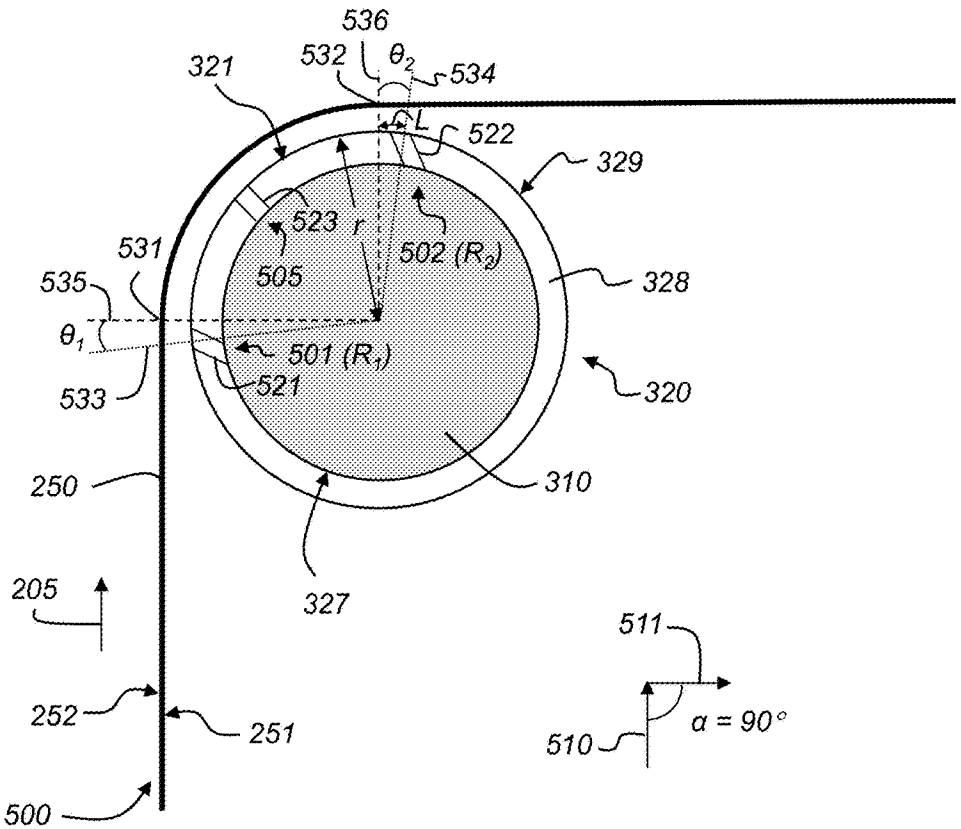
FIG. 7 shows a cross-sectional view of the web guide configuration of FIG. 6 indicating the locations of liquid ejection holes around the bearing surface.

FIG. 7 shows another view of the web guide 320 of FIG. 6 which more clearly indicates the circumferential location of the liquid ejection holes 521 of the first array 501 and the liquid ejection holes 522 of the second array 502. Web guide 320 has a web guide entry position 531, which is defined as the position at which the direction of the web of media 250 becomes tangent to the curved exterior surface 329 of curved wall 328 as the web of media 250 approaches the web guide 320 at the beginning of the bearing surface 321. Similarly, web guide 320 has a web guide exit position 532, which is defined as the position at which the direction of the web of media 250 becomes tangent to the curved exterior surface 329 of curved wall 328 as the web of media 250 moves away from the web guide 320 at the end of the bearing surface 321.

In the exemplary configuration shown in FIG. 7, the liquid ejection holes 521 of the first array 501 (row $R_1$) are located upstream of the web guide entry position 531. In particular, a radial line 533 that passes through the center of liquid ejection hole 521 at the curved exterior surface 329 is at an angle $\theta_1$ in an upstream direction with respect to a radial line 535 that intersects the web guide entry position 531. Similarly, the liquid ejection holes 522 of the second array 502 (row $R_2$) are located downstream of web guide exit position 532. In particular, a radial line 534 that passes through the center of liquid ejection hole 522 at the curved exterior surface 329 is at an angle $\theta_2$ in a downstream direction with respect to a radial line 536 that intersects the web guide exit position 532.

In testing that was done for a web guide 320 having the configuration shown in FIGS. 6 and 7 it was found that angles of $\theta_1=\theta_2=7.5$ degrees produced good results. More generally, magnitudes of angles $\theta_1$ and $\theta_2$ of about 15 degrees or less were found to be suitable. For a 2 inch diameter circular web guide, the circumference is 6.28 inches and an arc length corresponding to 7.5 degrees (1/48 of a full circle) is 0.13 inches. In general, for web guides having a bearing surface 321 with a radius of curvature r and a row position angle $\theta$ relative to the position of tangency, the circumferential distance L between the position of tangency at the web guide entry position 531 or the web guide exit position 532 is $L=\pi r \theta/180$.

As described above, the first array 501 of liquid ejection holes 521 is located in proximity to the web guide entry position 531, and the second array 502 of liquid ejection holes 522 is located "in proximity to" (i.e., "near to") the web guide exit position 532. In this context, relative to angular position the terms "in proximity to" or "near to" should be interpreted to mean within about 15 degrees, or relative to arc length they mean within a circumferential distance of about $L=\pi r/12$ (e.g., within about 0.26 inch for a 2 inch diameter circular web guide). This can include the first array 501 (row $R_1$) being located exactly at the web guide entry position 531, upstream of the web guide entry position 531 or downstream of the web guide entry position 531. This can also include the second array 502 (row $R_2$) being located exactly at the web guide exit position 532, downstream of the web guide exit position 532 or upstream of the web guide exit position 532.

Figure 8:
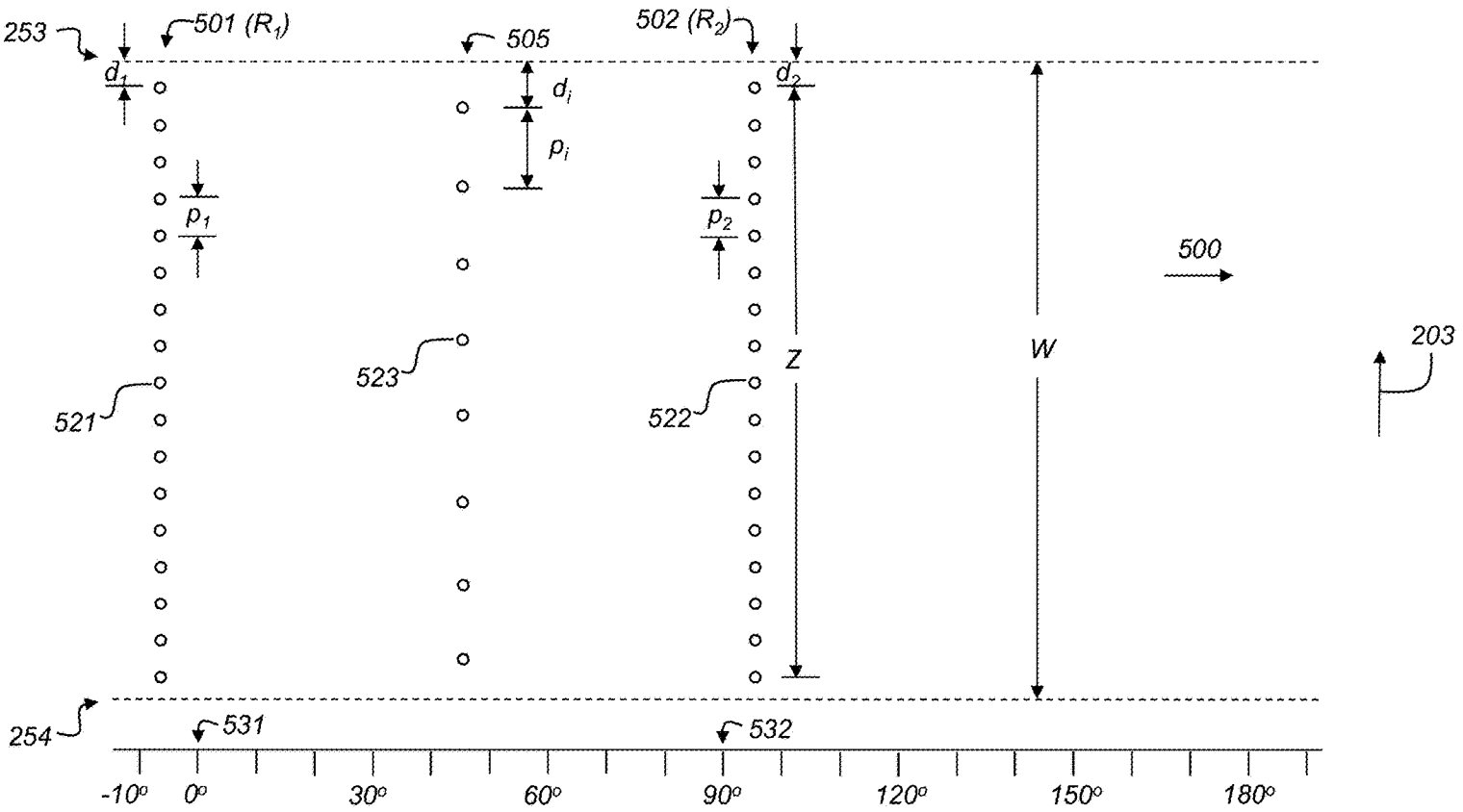
FIG. 8 shows a distribution plot of liquid ejection holes in the cross-track direction as a function of angle around the bearing surface for the web guide configuration of FIG. 6.

FIG. 8 shows a distribution plot of liquid ejection holes along the cross-track direction 203 as a function of angle around the curved exterior surface 329 for the web guide 320 example of FIGS. 6 and 7. The web guide entry position 531 is defined to be the zero angle position and the web guide exit position 532 is at 90 degrees. The positions of the first edge 253 and second edge 254 of the web of media 250 (FIG. 5) are indicated by dashed lines for reference. First array 501 (Row $R_1$) is located at −7.5 degrees (7.5 degrees upstream of web guide entry position 531), and second array 502 (Row $R_2$) is located at 97.5 degrees (7.5 degrees downstream of web guide exit position 532). Intermediate array 505 is a linear array located at 45 degrees (i.e., midway between the web guide entry position 531 and the web guide exit position 532).

In this exemplary configuration, the number of liquid ejection holes 521 in first array 501 (row $R_1$) is the same as the number of liquid ejection holes 522 in second array 502 (row $R_2$), and is about twice as many as the number of liquid ejection holes 523 in intermediate array 505. A distance $d_1$ between the outermost liquid ejection hole 521 in first row $R_1$ and first edge 253 of web of media 250 is about the same as the distance $d_2$ between the outermost liquid ejection hole 522 in second row $R_2$ and first edge 253 of web of media 250, and is about half as large as the distance $d_i$ between the outermost liquid ejection hole 523 in intermediate array 505 and first edge 253 of web of media 250. The uniform spacing or pitch $p_1$ between the liquid ejection holes 521 in first row $R_1$ is the same as the uniform pitch $p_2$ between the liquid ejection holes 522 in second row $R_2$, and is about half as large as the uniform pitch $p_i$ between the liquid ejection holes 523 in intermediate array 505. The spacing Z between the two end-most liquid ejection holes 522 in the second row $R_2$ is preferably less than the width W of the web of media 250. In this way, the processing liquid 310 is ejected at the web of media 250 rather than beyond the first and second edges 253, 254 of the web of media 250.

It has been found that the hole configuration described above with reference to FIGS. 5-8 works well for a 90 degree wrap angle web guide 320 having the same orientation of the bearing surface 321 whether the web guide 320 is submerged or partially submerged in the processing liquid 310 or even positioned above liquid level 311 so that it is non-submerged. It has also been found that a similar hole configuration works well for a range of other wrap angles between about 45 degrees and 120 degrees. For example, a submerged web guide 320 has been designed and tested with a 109 degree wrap angle. In this case, the web guide entry position 531 is separated from the web guide exit position 532 by 109 degrees, and the intermediate array 505 is a linear array located at 54.5°, which is midway between the web guide entry position 531 and the web guide exit position 532.

Figure 9:
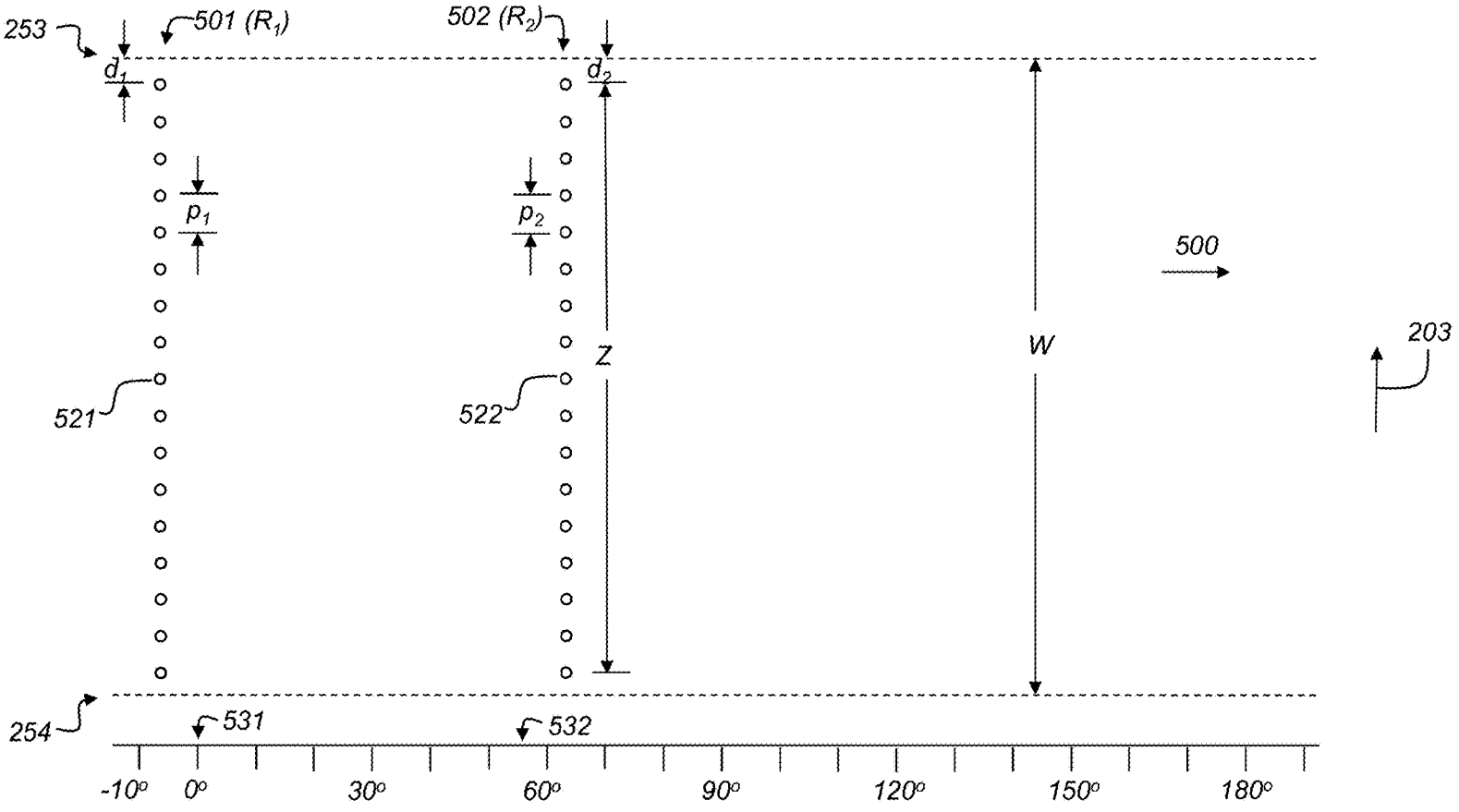
FIG. 9 shows a distribution plot similar to FIG. 8 for an embodiment having a wrap angle of 55 degrees.

FIG. 9 shows a hole configuration for another exemplary web guide 320 configuration having a 55 degree wrap angle with the bearing surface 321 at the upper left of the web guide as in FIG. 6. The primary difference relative to the hole configuration of FIGS. 6-8 is that there is no intermediate array 505 in the hole configuration of FIG. 9. There is only the first array 501 (row $R_1$) and the second array 502 (row $R_2$). There are no additional liquid ejection holes 523 disposed along the web transport path 500 around the bearing surface 321 (FIG. 6) between the first row $R_1$ of liquid ejection holes and the second row $R_2$ of liquid ejection holes 522. The web guide entry position 531 is defined to be at zero degrees, and the web guide exit position 532 is at 55 degrees. The 30 degree inclined liquid ejection holes 521 of first row $R_1$ are located 7.5 degrees upstream of the web guide entry position 531, and the 30 degree oppositely inclined liquid ejection holes 522 of second row $R_2$ are located 7.5 degrees downstream of the web guide exit position 532. In this case, it has been found that the intermediate array 505 of holes is not necessary due to the shorter circumferential distance between the first array 501 and the second array 502.

Figure 10:
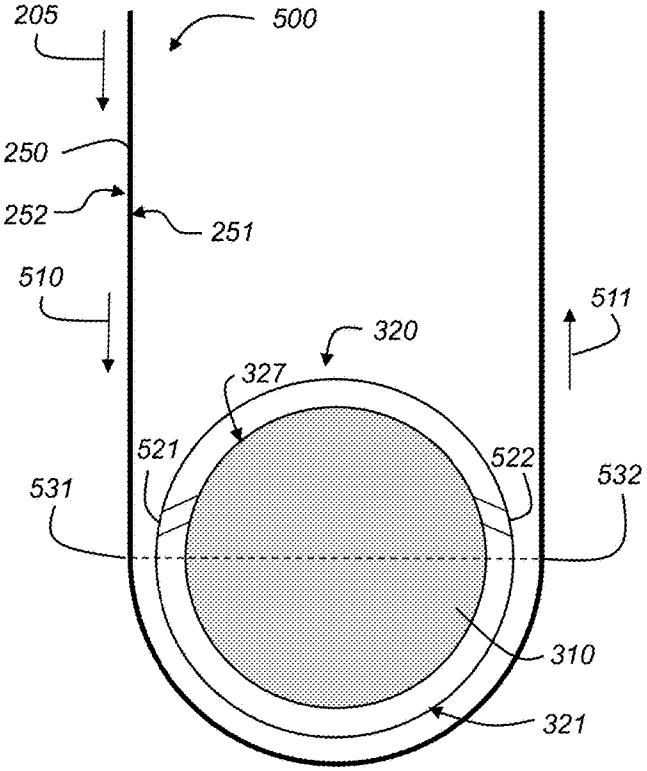
FIG. 10 shows a cross-sectional view of a non-contact web guide configuration having a wrap angle of 180 degrees.
Figure 11:
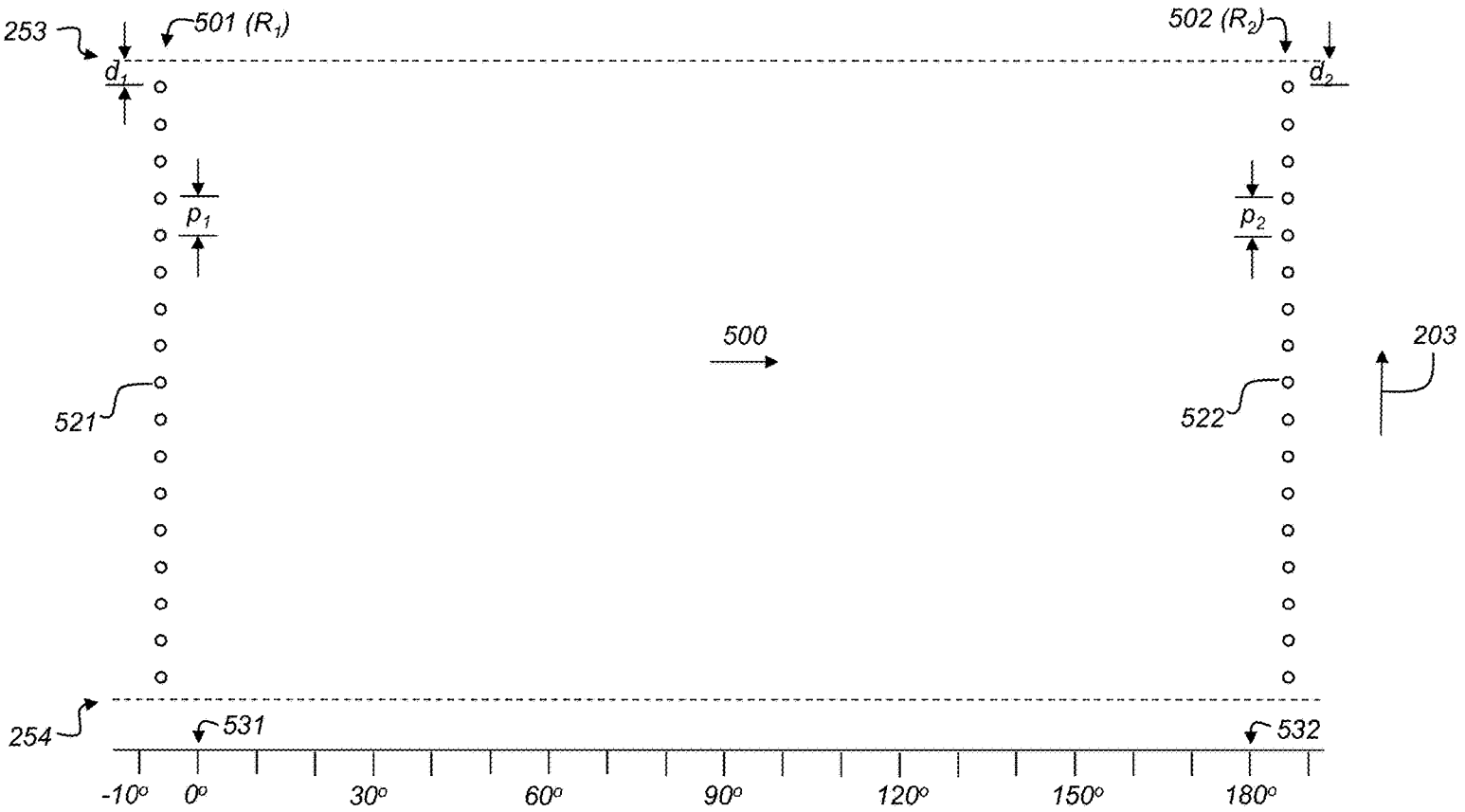
FIG. 11 shows a distribution plot similar to FIG. 8 for the web guide configuration of FIG. 10.

FIG. 10 shows a cross-sectional view of an exemplary submerged web guide 320 configuration having a 180 degree wrap angle with the center of the bearing surface 321 oriented toward the bottom. Input travel direction 510 is vertically downward and output travel direction 511 is vertically upward. The web guide entry position 531 is defined to be at zero degrees, and the web guide exit position 532 is at 180 degrees. In this example, the web guide entry position 531 is located at approximately the same height above the bottom of the web guide 320 as the web guide exit position 532. The 30 degree inclined liquid ejection holes 521 of first row $R_1$ are located 7.5 degrees upstream of the web guide entry position 531, and the 30 degree oppositely inclined liquid ejection holes 522 of second row $R_2$ are located 7.5 degrees downstream of the web guide exit position 532. As in the example of FIG. 9, there is no intermediate array 505 in the hole configuration of FIG. 10. It has been found that the intermediate array 505 is not necessary in this case because gravity will pull the liquid downward toward the bottom of the web guide 320 in this configuration. FIG. 11 shows the corresponding distribution of liquid ejection holes along the cross-track direction 203 as a function of angle.

Figure 12:
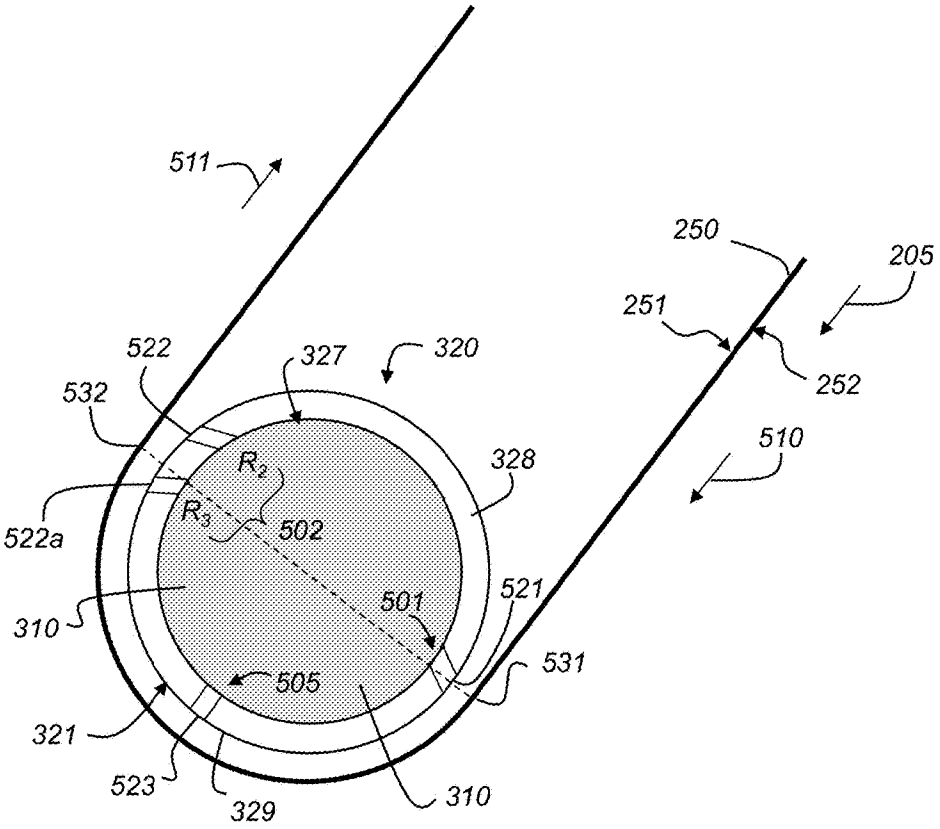
FIG. 12 shows a cross-sectional view of a non-submerged non-contact web guide configuration having a wrap angle of 180 degrees where the web guide entry position is near the bottom of the web guide.
Figure 13:
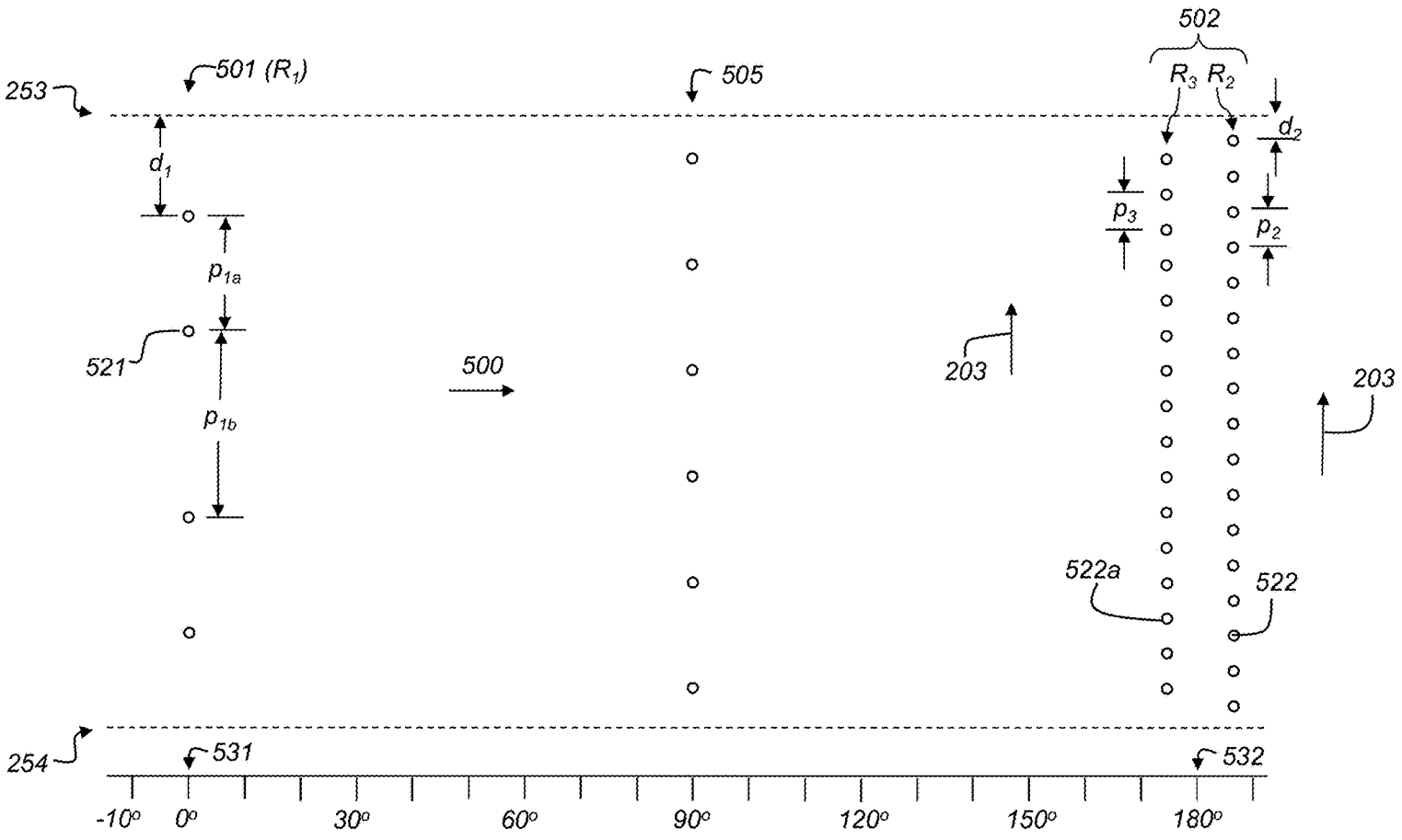
FIG. 13 shows a distribution plot similar to FIG. 8 for the web guide configuration of FIG. 12.

FIG. 12 shows a cross-sectional view of an exemplary non-submerged web guide 320 having a 180 degree wrap angle, with the web guide entry position 531 located near the bottom of the web guide 320 and the web guide exit position 532 located near the top of the web guide 320. Due to gravity, it was found that ejected processing liquid 310 tended to pool near the web guide entry position 531 if the first array 501 has a similar number of holes as the second array 502. With reference also to FIG. 13 which illustrates a hole configuration corresponding to FIG. 12, this problem was addressed by adding a third row R3 of liquid ejection holes 522*a* to the second row R2 of liquid ejection holes 522 in second array 502, while decreasing the number of liquid ejection holes 521 in the first array 501, and also decreasing the number of liquid ejection holes 523 in the intermediate array 505.

In the illustrated configuration, the liquid ejection holes 522*a* of third row R3 are formed through the curved wall 328 from the hollow interior 327 to the curved exterior surface 329 and are distributed along a line spanning the web guide 320 in the cross-track direction 203 at a position upstream of the web guide exit position 532. Both second row R2 and third row R3 are formed in proximity to the web guide exit position 532 with second row R2 being located 7.5 degrees downstream and third row R3 being located 7.5 degrees upstream of web guide exit position 532. The pitch p3 and number of liquid ejection holes 522*a* in third row R3 are approximately equal to the pitch p2 and the number of liquid ejection holes 522 in second row R2 (e.g., equal to within 10%). In the hole configuration shown in FIG. 13, the positions of liquid ejection holes 522*a* in the cross-track direction 203 in third row R3 are staggered relative to the positions of liquid ejection holes 522 in the second row R2. The first row R1 of liquid ejection holes 521 is located at the web guide entry position 531, and the total number of liquid ejection holes 521 in the first row R1 is less than a total number of liquid ejection holes 522 in the second row R2.

In the example of FIG. 13, the total number of liquid ejection holes 522 in the second array 502 (including rows $R_2$ and $R_3$) is much larger than the number of liquid ejection holes 521 in first array 501 (row $R_1$). In this case, the total number of liquid ejection holes 522 is more than five times greater than the number of liquid ejection holes 521, and in other configurations (not shown) it can be as large as ten or twenty times greater.

Additionally, the spacing of liquid ejection holes 521 is non-uniform in first row $R_1$ in the example of FIG. 13. The pitch $p_{1b}$ of liquid ejection holes 521 toward the center of web guide 320 in the cross-track direction 203 is greater than the pitch $p_{1a}$ of liquid ejection holes 521 toward the outer edges. Also, the distance $d_1$ between the outermost liquid ejection hole 521 in first array 501 and the first edge 253 of web of media 250 is greater than the distance $d_2$ between the outermost liquid ejection hole 522 in the second array 502 and first edge 253 of web of media 250. In other configurations, the spacing of liquid ejection holes 522 in some or all of the second row $R_2$, the third row $R_3$ or the intermediate array 505 can also be non-uniform.

With regard to the inclination of the various holes shown in FIG. 12, the 30 degree inclination of the first array 501 of liquid ejection holes 521 and the second array 502 of liquid ejection holes 522 is configured to eject processing liquid 310 into the region where the web of media 250 is wrapped around the bearing surface 321. The liquid ejection holes 523 of the intermediate array 505 are oriented with their axes perpendicular to the curved exterior surface 329 as in the example of FIG. 6.

In the exemplary web guide 320 described above with reference to FIGS. 12 and 13, more liquid ejection holes are provided near the web guide exit position 532 than near the web guide entry position 531 because of the tendency for the accumulation of ejected processing liquid 310 near the web guide entry position 531 due to gravitational effects. It is also contemplated that in analogous embodiments (not shown) where the web guide entry position 531 is near the top of the web guide 320 and the web guide exit position 532 is near the bottom of the web guide 320, the number of liquid ejection holes 521 in the first array 501 can be greater than the number of liquid ejection holes 522 in the second array 502, and the asymmetry of the distribution of liquid ejection holes in the first and second arrays 501 and 502 can be reversed relative to the distribution shown in FIG. 13.

Figure 14:
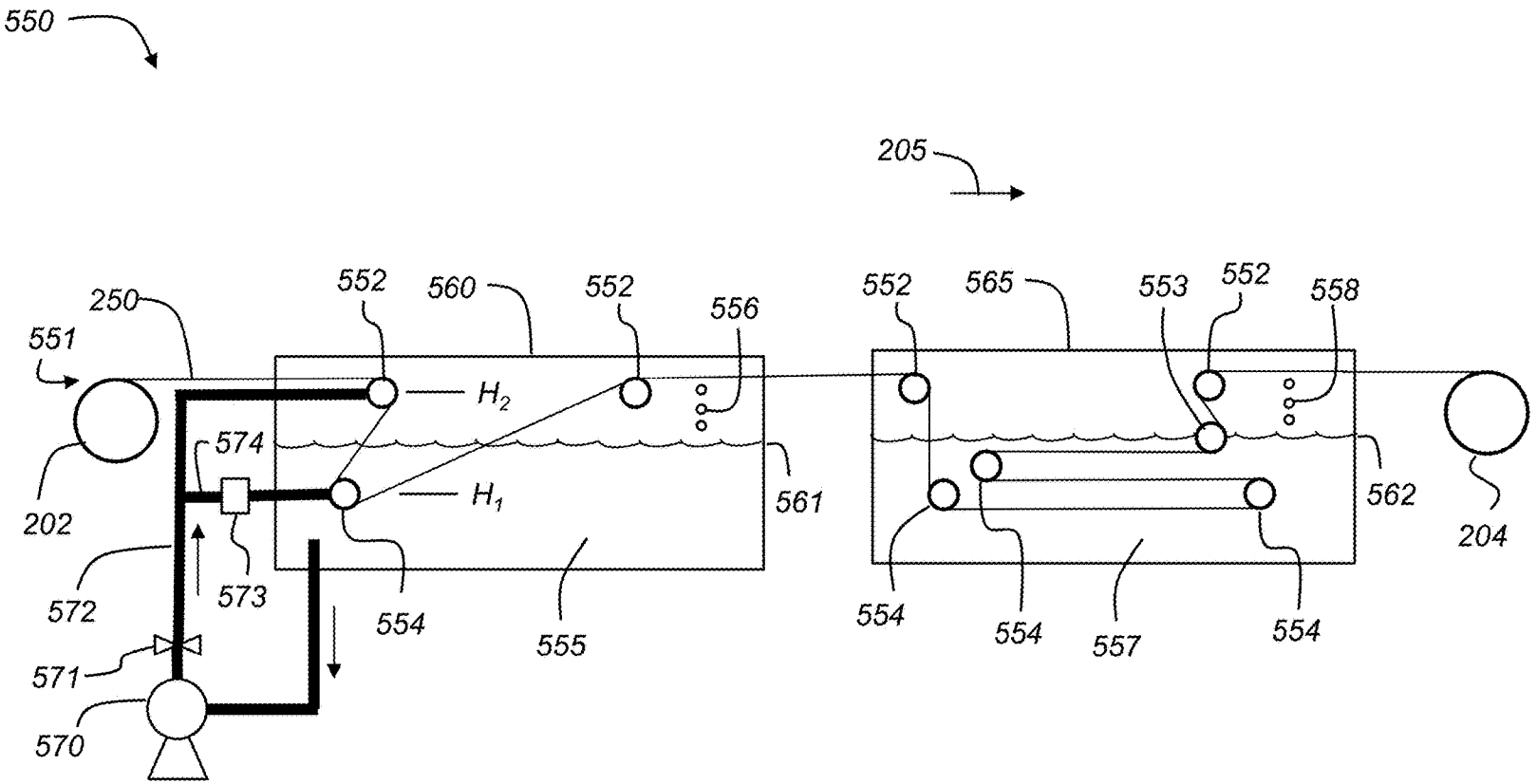
FIG. 14 shows a roll-to roll liquid processing system having non-contact web guides of various configurations.

FIG. 14 shows a schematic side view of a roll-to-roll liquid processing system 550 having a web transport system 551 for guiding a web of media 250 between the supply roll 202 and the take-up roll 204 through a plurality of processing tanks, including processing tank 560 containing processing liquid 555 up to a liquid level 561, and processing tank 565 containing processing liquid 557 up to a liquid level 562. Web of media 250 is guided through processing tank 560 by a first arrangement of non-contact web guides including two non-submerged web guides 552 and one submerged web guide 554. Subsequently web of media 250 is guided through processing tank 565 by a second arrangement of non-contact web guides including two non-submerged web guides 552, three submerged web guides 554 and one partially-submerged web guide 553. The various non-submerged web guides 552, partially-submerged web guides 553 and submerged web guides 554 have a variety wrap angles and orientations of the respective bearing surfaces, and can eject different processing liquids through liquid ejection holes (not shown in FIG. 14). As described above with reference to FIGS. 6-13, configurations of liquid ejection holes for at least some of the non-contact web guides (both within a single processing tank 560 or 565 as well as from processing tank 560 to processing tank 565) will generally be different.

As was described above with reference to FIGS. 4-6, a pump provides the pressurized liquid that is ejected through the liquid ejection holes. Each web guide can be independently pressurized by its own pump, but in some embodiments a single pump is used to pressurize two or more web guides. For simplicity, only one pump 570 is shown in FIG. 14. Pump 570 pumps liquid from the reservoir of processing liquid 555 in processing tank 560 through a distribution line 572 into the hollow interior 327 (FIG. 6) of the web guides. For simplicity, FIG. 14 shows the pump 570 supplying processing liquid 555 to one non-submerged web guide 552 and one submerged web guide 554. However, it will be desirable in many configurations for a single pump 570 to supply all of the web guides associated with the processing tank 560.

Optionally a valve 571 is provided downstream of pump 570 for controlling the overall flow rate. After the processing liquid 555 is ejected through the liquid ejection holes, it is subsequently directed back into the reservoir of processing liquid 555 in the processing tank 560. For submerged web guides 554, the processing liquid 555 in the submerged web guide 554 is ejected directly back into the reservoir of processing liquid 555. For a non-submerged web guide 552, the ejected processing liquid 555 falls back as a stream or as droplets 556 into the reservoir of processing liquid 555 in processing tank 560. Similarly for processing tank 565, for a non-submerged web guide 552, the ejected processing liquid 557 falls back as a stream or as droplets 558 into the reservoir of processing liquid 557 in processing tank 565.

Submerged web guide 554 is positioned at a first height $H_1$ within processing tank 560 and non-submerged web guide 552 is positioned at a second height $H_2$ within processing tank 560, where the second height $H_2$ is greater than first height $H_1$. There will be a pressure drop in the processing liquid 557 in the distribution line 572 which will be proportional to the difference in heights. In order to prevent over-pressurizing a web guide that is positioned lower (leading to too much web stand-off) or under-pressurizing a web guide that is positioned higher (leading to too little web stand-off), restrictor(s) 573 can be provided to control the pressure provided to one or more of the web guides. In the illustrated configuration, a restrictor 573 is provided in the branch 574 of the distribution line 572 that leads to submerged web guide 554. Restrictor 573 can include a fixed restriction, such as a reduction of the cross-section of a portion of a branch 574, or it can include an adjustable restriction such as a valve for controlling flow rate and web stand-off independently for submerged web guide 554 and non-submerged web guide 552. In any case, restrictor 573 provides a pressure drop in branch 574 to compensate for the pressure drop associated with the difference in heights $H_2-H_1$. In some configurations, restrictors 573 can also be used in the to compensate for other factors such as differences in hole patterns or differences in the required flow rates for different web guides 552, 554.

The examples described above describe web transport systems using liquid bearings that can be used in liquid processing systems such as an electroless plating system, where the processing liquid from a processing tank is used to provide a liquid bearing. More generally, web transport systems can use liquid bearings even in the absence of processing liquids and processing tanks, and such web transport systems can include non-contact web guides with liquid ejection hole configurations analogous to those described herein.

Figure 15:
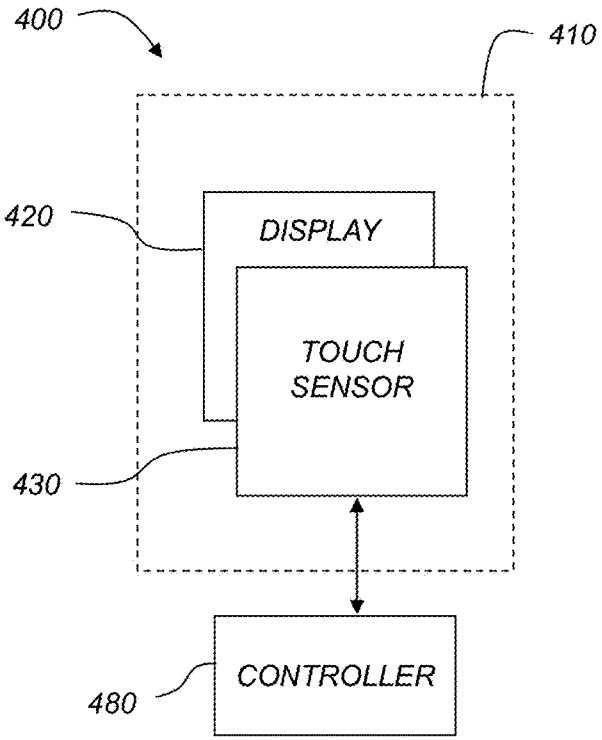
FIG. 15 is a high-level system diagram for an apparatus having a touch screen with a touch sensor that can be printed using embodiments of the invention.

FIG. 15 shows a high-level system diagram for an apparatus 400 having a touch screen 410 including a display device 420 and a touch sensor 430 that overlays at least a portion of a viewable area of display device 420. Touch sensor 430 senses touch and conveys electrical signals (related to capacitance values for example) corresponding to the sensed touch to a controller 480. Touch sensor 430 is an example of an article that can be printed on one or both sides by the flexographic printing system 100 and plated using an embodiment of roll-to-roll liquid processing system 300 where the web of media 250 is guided by non-contact web guides having liquid ejection hole configurations as described above.

Figure 16:
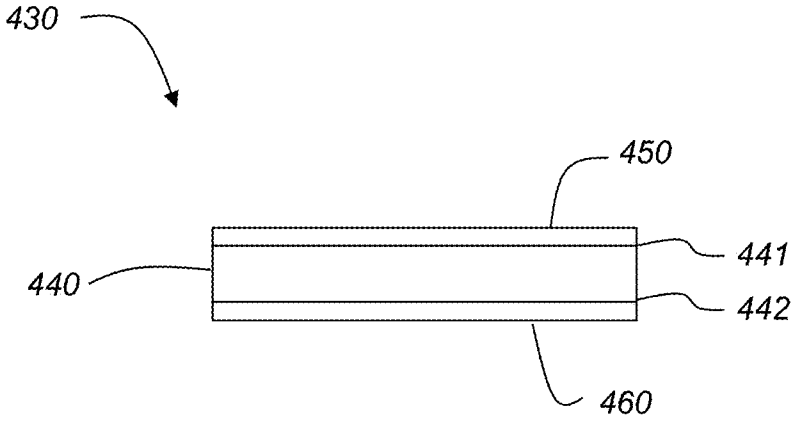
FIG. 16 is a side view of the touch sensor of FIG. 15.

FIG. 16 shows a schematic side view of a touch sensor 430. Transparent substrate 440, for example polyethylene terephthalate, has a first conductive pattern 450 printed and plated on a first side 441, and a second conductive pattern 460 printed and plated on a second side 442. The length and width of the transparent substrate 440, which is cut from the take-up roll 104 (FIG. 1), is not larger than the flexographic printing plates 112, 122, 132, 142 of flexographic printing system 100 (FIG. 1), but it could be smaller than the flexographic printing plates 112, 122, 132, 142.

Figure 17:
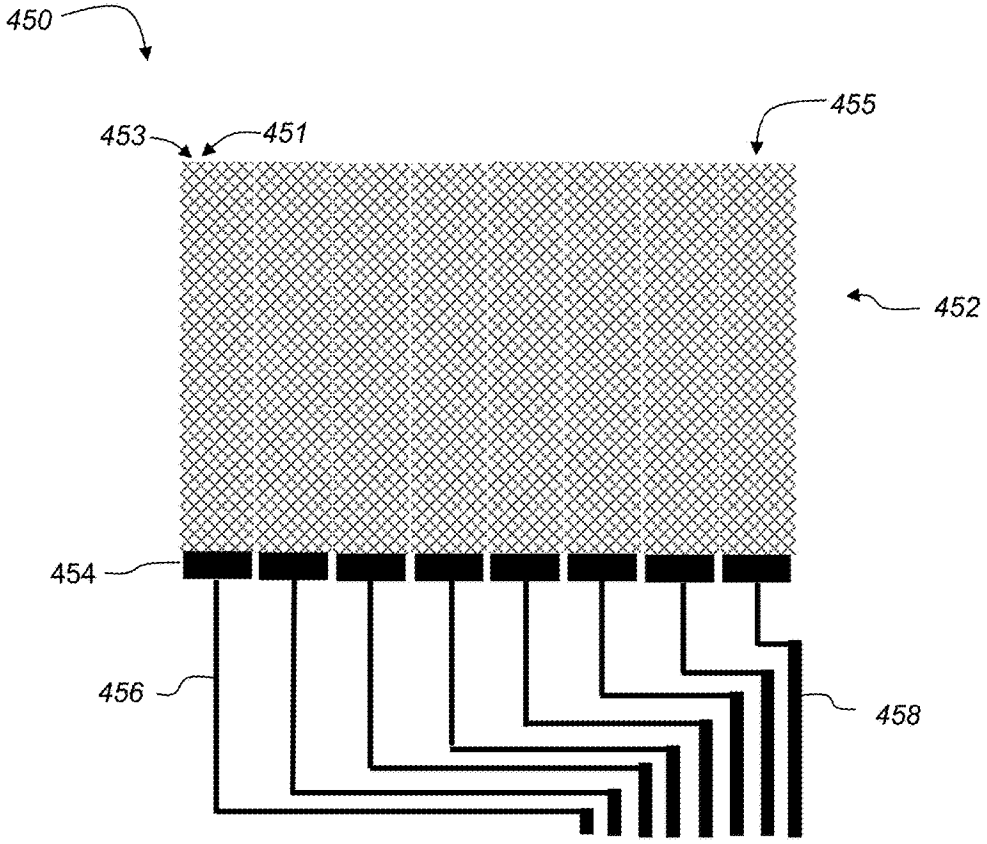
FIG. 17 is a top view of a conductive pattern printed on a first side of the touch sensor of FIG. 16.

FIG. 17 shows an example of a conductive pattern 450 that can be printed on first side 441 (FIG. 16) of substrate 440 (FIG. 16) using one or more print modules such as print modules 120 and 140 of flexographic printing system (FIG. 1), followed by plating using a roll-to-roll liquid processing system 300 or 550 (FIGS. 3 and 14). Conductive pattern 450 includes a grid 452 including grid columns 455 of intersecting fine lines 451 and 453 that are connected to an array of channel pads 454. Interconnect lines 456 connect the channel pads 454 to the connector pads 458 that are connected to controller 480 (FIG. 15). Conductive pattern 450 can be printed by a single print module 120 in some embodiments. However, because the optimal print conditions for fine lines 451 and 453 (e.g., having line widths on the order of 4 to 8 microns) are typically different than for printing the wider channel pads 454, connector pads 458 and interconnect lines 456, it can be advantageous to use one print module 120 for printing the fine lines 451 and 453 and a second print module 140 for printing the wider features. Furthermore, for clean intersections of fine lines 451 and 453, it can be further advantageous to print and cure one set of fine lines 451 using one print module 120, and to print and cure the second set of fine lines 453 using a second print module 140, and to print the wider features using a third print module (not shown in FIG. 1) configured similarly to print modules 120 and 140.

Figure 18:
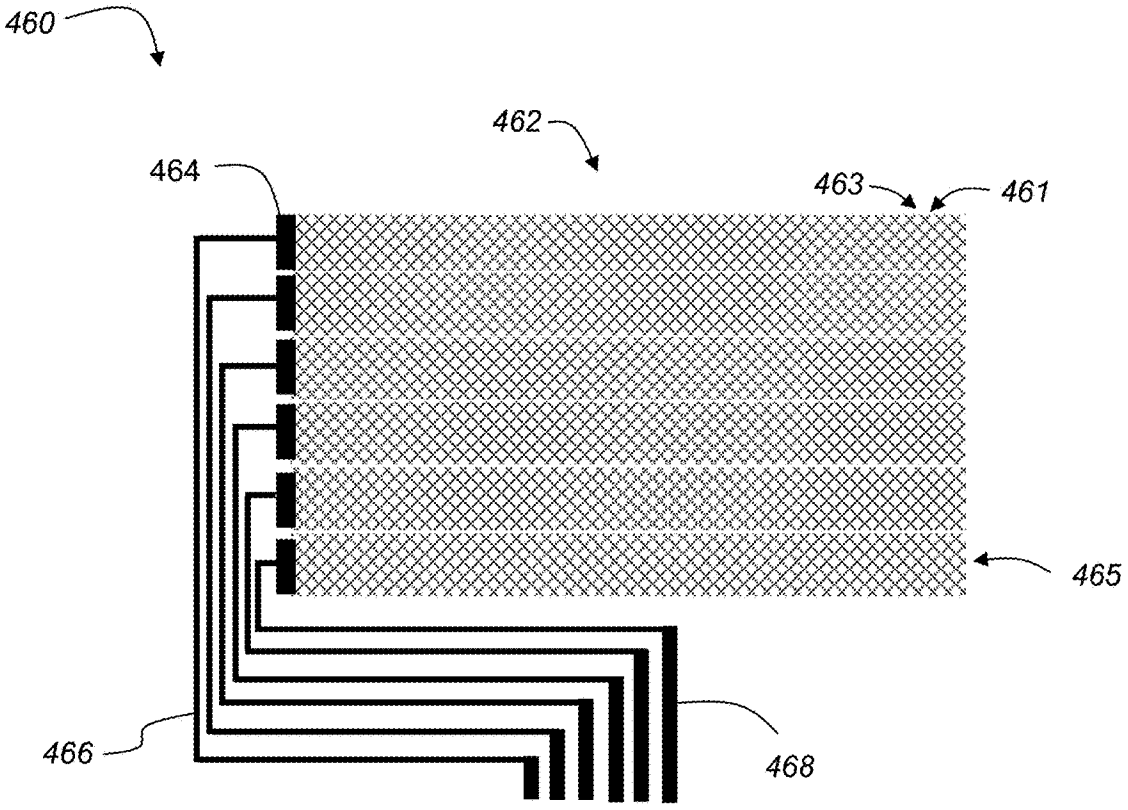
FIG. 18 is a top view of a conductive pattern printed on a second side of the touch sensor of FIG. 16.

FIG. 18 shows an example of a conductive pattern 460 that can be printed on second side 442 (FIG. 16) of transparent substrate 440 (FIG. 16) using one or more print modules such as print modules 110 and 130 of flexographic printing system (FIG. 1), followed by plating using a roll-to-roll liquid processing system 300 or 550 (FIGS. 3 and 14). Conductive pattern 460 includes a grid 462 including grid rows 465 of intersecting fine lines 461 and 463 that are connected to an array of channel pads 464. Interconnect lines 466 connect the channel pads 464 to the connector pads 468 that are connected to controller 480 (FIG. 15). In some embodiments, conductive pattern 460 can be printed by a single print module 110. However, because the optimal print conditions for fine lines 461 and 463 (e.g., having line widths on the order of 4 to 8 microns) are typically different than for the wider channel pads 464, connector pads 468 and interconnect lines 466, it can be advantageous to use one print module 110 for printing the fine lines 461 and 463 and a second print module 130 for printing the wider features. Furthermore, for clean intersections of fine lines 461 and 463, it can be further advantageous to print and cure one set of fine lines 461 using one print module 110, and to print and cure the second set of fine lines 463 using a second print module 130, and to print the wider features using a third print module (not shown in FIG. 1) configured similarly to print modules 110 and 130.

Alternatively, in some embodiments conductive pattern 450 can be printed using one or more print modules configured like print modules 110 and 130, and conductive pattern 460 can be printed using one or more print modules configured like print modules 120 and 140 of FIG. 1 followed by plating using a roll-to-roll liquid processing system.

With reference to FIGS. 15-18, in operation of touch screen 410, controller 480 can sequentially electrically drive grid columns 455 via connector pads 458 and can sequentially sense electrical signals on grid rows 465 via connector pads 468. In other embodiments, the driving and sensing roles of the grid columns 455 and the grid rows 465 can be reversed.

The invention has been described in detail with particular reference to certain preferred embodiments thereof, but it will be understood that variations and modifications can be effected within the spirit and scope of the invention.

PARTS LIST

100 flexographic printing system
102 supply roll
104 take-up roll
105 roll-to-roll direction
106 roller
107 roller
110 print module
111 plate cylinder
112 flexographic printing plate
113 raised features
114 impression cylinder
115 anilox roller
116 UV curing station
120 print module
121 plate cylinder

122 flexographic printing plate
124 impression cylinder
125 anilox roller
126 UV curing station
130 print module
131 plate cylinder
132 flexographic printing plate
134 impression cylinder
135 anilox roller
136 UV curing station
140 print module
141 plate cylinder
142 flexographic printing plate
144 impression cylinder
145 anilox roller
146 UV curing station
150 substrate
151 first side
152 second side
200 roll-to-roll electroless plating system
202 supply roll
203 cross-track direction
204 take-up roll
205 in-track direction
206 drive roller
207 drive roller
208 web-guiding roller
210 plating solution
215 replenished plating solution
220 reservoir
230 tank
232 drain pipe
234 return pipe
236 filter
240 pump
242 controller
250 web of media
251 first surface
252 second surface
253 first edge
254 second edge
300 roll-to-roll liquid processing system
301 web transport system
302 non-submerged web guide
304 submerged web guide
305 processing liquid
310 processing liquid
311 liquid level
320 web guide
321 bearing surface
322 liquid ejection holes
323 first end
324 second end
325 first mount
326 second mount
327 hollow interior
328 curved wall
329 curved exterior surface
330 processing tank
335 processing tank
340 processing tank
345 processing tank
400 apparatus
410 touch screen
420 display device
430 touch sensor
440 transparent substrate
441 first side
442 second side
450 conductive pattern
451 fine lines
452 grid
453 fine lines
454 channel pads
455 grid column
456 interconnect lines
458 connector pads
460 conductive pattern
461 fine lines
462 grid
463 fine lines
464 channel pads
465 grid row
466 interconnect lines
468 connector pads
480 controller
500 web transport path
501 first array
502 second array
505 intermediate array
510 input travel direction
511 output travel direction
521 liquid ejection hole
522 liquid ejection hole
523 liquid ejection hole
524 axis
525 axis
526 axis
527 normal
528 normal
529 normal
531 web guide entry position
532 web guide exit position
533 radial line
534 radial line
535 radial line
536 radial line
550 roll-to-roll liquid processing system
551 web transport system
552 non-submerged web guide
553 partially-submerged web guide
554 submerged web guide
555 processing liquid
556 droplets
557 processing liquid
558 droplets
560 processing tank
561 liquid level
562 liquid level
565 processing tank
570 pump
571 valve
572 distribution line
573 restrictor
574 branch
$d_1$ distance
$d_2$ distance
$d_i$ distance
D diameter
$H_1$ height
$H_2$ height
L circumferential distance
$p_1$ pitch
$p_{1a}$ pitch $p_{1b}$ pitch
$p_2$ pitch
$p_3$ pitch
$p_i$ pitch
r radius of curvature
$R_1$ first row
$R_2$ second row
$R_3$ third row
$R_i$ intermediate row
S stand-off distance
T wall thickness
W width
Z spacing
$\alpha$ wrap angle
$\beta_1$ inclination angle
$\beta_2$ inclination angle
$\theta_1$ angle
$\theta_2$ angle

The invention claimed is:

1. A web transport system for transporting a web of media along a web transport path in an in-track direction, the web of media having a width in a cross-track direction, comprising:

at least one web guide for non-contact guidance of the web of media including:

a wall having a curved exterior surface, wherein the web of media travels along the web transport path around a bearing portion of the curved exterior surface from a web guide entry position to a web guide exit position, thereby redirecting the web of media from an input travel direction to an output travel direction;

a hollow interior containing a pressurized liquid;

a first row of liquid ejection holes formed through the wall from the hollow interior to the curved exterior surface, the liquid ejection holes in the first row being distributed along a line spanning the web guide in the cross-track direction in proximity to the web guide entry position;

a second row of liquid ejection holes formed through the wall from the hollow interior to the curved exterior surface, the liquid ejection holes in the second row being distributed along a line spanning the web guide in a cross-track direction in proximity to the web guide exit position;

a third row of liquid ejection holes formed through the wall from the hollow interior to the curved exterior surface, the liquid ejection holes in the third row being distributed along a line spanning the web guide in the cross-track direction at a position upstream of the web guide exit position, wherein cross-track positions of the liquid ejection holes in the third row are staggered relative to cross-track positions of the liquid ejection holes in the second row; and an intermediate array of liquid ejection holes formed through the wall from the hollow interior to the curved exterior surface disposed along the web transport path between the first row of liquid ejection holes and the second row of liquid ejection holes, the liquid ejection holes in the intermediate array being distributed across the web guide in the cross-track direction, wherein a total number of liquid ejection holes in the intermediate array is less than a total number of liquid ejection holes in the second row;

wherein the pressurized liquid flows through the liquid ejection holes to force the web of media away from the bearing portion of the web guide so that the web of media does not contact the web guide as it travels around the bearing portion of the curved exterior surface.

2. The web transport system of claim 1, wherein the first row of liquid ejection holes is located at the web guide entry position.

3. The web transport system of claim 1, wherein the first row of liquid ejection holes is located upstream of the web guide entry position.

4. The web transport system of claim 1, wherein the second row of liquid ejection holes is located at the web guide exit position.

5. The web transport system of claim 1, wherein the second row of liquid ejection holes is located downstream of the web guide exit position.

6. The web transport system of claim 1, wherein a total number of liquid ejection holes in the third row is within 10% of a total number of liquid ejection holes in the second row.

7. The web transport system of claim 1, wherein a total number of liquid ejection holes in the first row is less than a total number of liquid ejection holes in the second row.

8. The web transport system of claim 1, wherein the liquid ejection holes in the first row or second row are spaced apart by a non-uniform spacing.

9. The web transport system of claim 1, wherein the liquid ejection holes in the first row or second row are spaced apart by a uniform spacing.

10. The web transport system of claim 9, wherein the intermediate liquid ejection holes in the array are spaced apart by a uniform spacing that is greater than the uniform spacing between the liquid ejection holes in the second row.

11. The web transport system of claim 1, wherein outermost liquid ejection holes in the second row are separated by a distance that is less than the width of the web of media.

12. The web transport system of claim 1, wherein an outermost liquid ejection hole in the second row is disposed at a first distance from a first edge of the web of media, and an outermost liquid ejection hole in the intermediate array is disposed at a second distance from the first edge of the web of media that is greater than the first distance.

13. The web transport system of claim 1, further including a processing tank containing a reservoir of the liquid, wherein the web transport path carries the web of media through the liquid in the processing tank.

14. The web transport system of claim 13, further including a pump that pumps liquid from the reservoir of the liquid in the processing tank into the hollow interior of the web guide to provide the pressurized liquid, and wherein the pressurized liquid that flows through the liquid ejection holes is subsequently directed hack into the reservoir of the liquid in the processing tank.

15. The web transport system of claim 14, wherein the at least one web guide includes a first web guide positioned at a first height within the processing tank and a second web guide positioned at a second height within the processing tank that is greater than the first height.

16. The web transport system of claim 15, wherein a single pump is used to pressurize the liquid in both the first web guide and the second web guide.

17. The web transport system of claim 16, further including a restrictor positioned in a liquid distribution line that carries pressurized liquid from the pump to the first web guide.

18. The web transport system of claim 1, wherein the wall has a wall thickness and the liquid ejection holes in the first and second arrays have a characteristic diameter, and wherein a ratio of the wall thickness to the characteristic diameter is between about 1.5 and 3.0.

19. The web transport system of claim 1, wherein a flow rate of the pressurized liquid through the liquid ejection holes is controlled to provide a stand-off distance between web of media and the bearing portion of the web guide of between about 0.5 mm and 1.0 mm.

20. The web transport system of claim 1, wherein the at least one web guide includes a first web guide and a second web guide, and wherein a configuration of liquid ejection holes in the first web guide is different from a configuration of liquid ejection holes in the second web guide.

21. The web transport system of claim 1, wherein the liquid is an electroless plating solution.

22. A web transport system for transporting a web of media along a web transport path in an in-track direction, the web of media having a width in a cross-track direction, comprising:

at least one web guide for non-contact guidance of the web of media including:

a wall having a curved exterior surface, wherein the web of media travels along the web transport path around a bearing portion of the curved exterior surface from a web guide entry position to a web guide exit position, thereby redirecting the web of media from an input travel direction to an output travel direction;

a hollow interior containing a pressurized liquid;

a first row of liquid ejection holes formed through the wall from the hollow interior to the curved exterior surface, the liquid ejection holes in the first row being distributed along a line spanning the web guide in the cross-track direction in proximity to the web guide entry position;

a second row of liquid ejection holes formed through the wall from the hollow interior to the curved exterior surface, the liquid ejection holes in the second row being distributed along a line spanning the web guide in a cross-track direction in proximity to the web guide exit position;

a third row of liquid ejection holes formed through the wall from the hollow interior to the curved exterior surface, the liquid ejection holes in the third row being distributed along a line spanning the web guide in the cross-track direction at a position upstream of the web guide exit position, wherein cross-track positions of the liquid ejection holes in the third row are staggered relative to cross-track positions of the liquid ejection holes in the second row; and an intermediate array of liquid ejection holes formed through the wall from the hollow interior to the curved exterior surface disposed along the web transport path between the first row of liquid ejection holes and the second row of liquid ejection holes, the liquid ejection holes in the intermediate array being distributed across the web guide in the cross-track direction, wherein a total cross-sectional area of the liquid ejection holes in the intermediate array is less than a total cross-sectional area of the liquid ejection holes in the second row;

wherein the pressurized liquid flows through the liquid ejection holes to force the web of media away from the bearing portion of the web guide so that the web of media does not contact the web guide as it travels around the beating portion of the curved exterior surface.

23. A web transport system for transporting a web of media along a web transport path in an in-track direction, the web of media having a width in a cross-track direction, comprising:

at least one web guide for non-contact guidance of the web of media including:

a wall having a curved exterior surface, wherein the web of media travels along the web transport path around a bearing portion of the curved exterior surface from a web guide entry position to a web guide exit position, thereby redirecting the web of media from an input travel direction to an output travel direction;

a hollow interior containing a pressurized liquid;

a first row of liquid ejection holes formed through the wall from the hollow interior to the curved exterior surface, the liquid ejection holes in the first row being distributed along a line spanning the web guide in the cross-track direction in proximity to the web guide entry position;

a second row of liquid ejection holes formed through the wall from the hollow interior to the curved exterior surface, the liquid ejection holes in the second row being distributed along a line spanning the web guide in a cross-track direction in proximity to the web guide exit position; and an intermediate array of liquid ejection holes formed through the wall from the hollow interior to the curved exterior surface disposed along the web transport path between the first row of liquid ejection holes and the second row of liquid ejection holes, the liquid ejection holes in the intermediate array being distributed across the web guide in the cross-track direction, wherein a total number of liquid ejection holes in the intermediate array is less than a total number of liquid ejection holes in the second row;

wherein the pressurized liquid flows through the liquid ejection holes to force the web of media away from the bearing portion of the web guide so that the web of media does not contact the web guide as it travels around the bearing portion of the curved exterior surface;

wherein the wall has a wall thickness and the liquid ejection holes in the first and second arrays have a characteristic diameter, and wherein a ratio of the wall thickness to the characteristic diameter is between about 1.5 and 3.0.

* * * * *